US009956453B2

(12) United States Patent
Madson et al.

(10) Patent No.: US 9,956,453 B2
(45) Date of Patent: May 1, 2018

(54) GOLF BALLS HAVING VOLUMETRIC EQUIVALENCE ON OPPOSING HEMISPHERES AND SYMMETRIC FLIGHT PERFORMANCE AND METHODS OF MAKING SAME

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days. days.

(21) Appl. No.: 15/228,360

(22) Filed: Aug. 4, 2016

(65) Prior Publication Data

US 2018/0036596 A1 Feb. 8, 2018

(51) Int. Cl.
*A63B 37/00* (2006.01)

(52) U.S. Cl.
CPC ..... *A63B 37/0006* (2013.01); *A63B 37/002* (2013.01); *A63B 37/0009* (2013.01); *A63B 37/0012* (2013.01)

(58) Field of Classification Search
CPC ..... A63B 37/0006; A63B 37/0009; A63B 37/0012; A63B 37/002
See application file for complete search history.

(56) References Cited

U.S. PATENT DOCUMENTS

| | | | | |
|---|---|---|---|---|
| 5,192,078 | A * | 3/1993 | Woo | A63B 37/0004 40/327 |
| 5,566,943 | A | 10/1996 | Boehm | 473/384 |
| 6,729,976 | B2 | 5/2004 | Bissonnette et al. | 473/383 |
| 6,796,912 | B2 | 9/2004 | Dalton et al. | 473/383 |
| 7,887,439 | B2 | 2/2011 | Aoyama et al. | 473/383 |
| 8,632,426 | B2 | 1/2014 | Madson et al. | 473/383 |
| 9,707,450 | B1 * | 7/2017 | Madson | A63B 37/0006 |
| 2006/0116222 | A1 * | 6/2006 | Sajima | A63B 37/0021 473/383 |
| 2011/0065531 | A1 * | 3/2011 | Goodwin | A63B 37/0004 473/383 |
| 2012/0165130 | A1 | 6/2012 | Madson et al. | 473/384 |
| 2014/0135146 | A1 * | 5/2014 | Madson | A63B 37/0006 473/383 |
| 2014/0135147 | A1 | 5/2014 | Madson et al. | 473/383 |

* cited by examiner

*Primary Examiner* — John E Simms, Jr.
(74) *Attorney, Agent, or Firm* — Mandi B. Milbank

(57) ABSTRACT

Golf balls according to the present invention achieve flight symmetry and overall satisfactory flight performance due to a dimple volume ratio that is equivalent between opposing hemispheres despite the use of different dimple geometries on the opposing hemispheres.

14 Claims, 18 Drawing Sheets

GOLF BALLS HAVING VOLUMETRIC EQUIVALENCE ON OPPOSING HEMISPHERES AND SYMMETRIC FLIGHT PERFORMANCE AND METHODS OF MAKING SAME

FIELD OF THE INVENTION

The present invention relates to golf balls with symmetric flight performance due to volumetric equivalence in the dimples on opposing hemispheres on the ball. In particular, golf balls according to the present invention achieve flight symmetry and overall satisfactory flight performance due to a dimple volume ratio that is equivalent between opposing hemispheres despite the use of different dimple geometries on the opposing hemispheres.

BACKGROUND OF THE INVENTION

Golf balls were originally made with smooth outer surfaces. However, in the late nineteenth century, players observed that gutta-percha golf balls traveled further as they aged and their surfaces were roughened. As a result, players began roughening the surfaces of new golf balls to increase flight distance; and manufacturers began molding non-smooth outer surfaces on golf balls.

By the mid 1900's almost every manufactured golf ball had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which, not surprisingly, had 384 dimples that were arranged in an icosahedral pattern. With about 76 percent of its outer surface covered with dimples, the TITLEIST 384 exhibited improved aerodynamic performance. Today, dimpled golf balls travel nearly two times farther than similar balls without dimples.

The dimples on a golf ball play an important role in reducing drag and increasing lift. More specifically, the dimples on a golf ball create a turbulent boundary layer around the ball, i.e., a thin layer of air adjacent to the ball that flows in a turbulent manner. The turbulent nature of the boundary layer of air around the ball energizes the boundary layer, and helps the air flow stay attached farther around the ball. The prolonged attachment of the air flow around the surface of the ball reduces the area of the wake behind the ball, effectively yielding an increase in pressure behind the ball, thereby substantially reducing drag and increasing lift on the ball during flight.

As such, manufacturers continually experiment with different dimple shapes and patterns in an effort to improve the aerodynamic forces exerted on golf balls, with the goal of increasing travel distances of the balls. However, the United States Golf Association (USGA) requires that a ball must not be designed, manufactured, or intentionally modified to have properties that differ from those of a spherically symmetric ball. In other words, manufacturers desire to better aerodynamic performance of a golf ball are also required to conform with the overall distance and symmetry requirements of the USGA. In particular, a golf ball is considered to achieve flight symmetry when it is found, under calibrated testing conditions, to fly at substantially the same height and distance, and remain in flight for substantially the same period of time, regardless of how it is placed on the tee. The testing conditions for assessing flight symmetry of a golf ball are provided in USGA-TPX3006, Revision 2.0.0, "Actual Launch Conditions Overall Distance and Symmetry Test Procedure (Phase II)". Accordingly, conventional golf balls typically remain hemispherically identical with regard to the dimples thereon in order to maintain the required flight symmetry and performance.

As such, there has been little to no focus on the use of differing dimple geometry on the opposing hemispheres of a golf ball—likely due to the previous inability to achieve volumetric equivalence between the opposing hemispheres and, thus, flight symmetry. Accordingly, there remains a need in the art for a golf ball that has opposing hemispheres that differ from one another in that the dimple shapes and/or dimple profiles are not identical on both hemispheres, while still achieving flight symmetry and overall satisfactory flight performance.

SUMMARY OF THE INVENTION

The present invention is directed to a golf ball including a first hemisphere including a first plurality of dimples; and a second hemisphere including a second plurality of dimples, wherein each dimple in the first plurality of dimples has a corresponding dimple in the second plurality of dimples, wherein a dimple in the first hemisphere includes a first profile shape and a corresponding dimple in the second hemisphere includes a second profile shape, wherein the first profile shape is different from the second profile shape and the first and second profile shapes are selected from the group consisting of spherical, catenary, and conical, and the dimple in the first hemisphere and the corresponding dimple in the second hemisphere have substantially identical surface volumes. For example, the first profile shape may be spherical while the second profile shape may be catenary. In another embodiment, the first profile shape may be spherical while the second profile shape may be conical. In still another embodiment, the first profile shape may be conical while the second profile shape may be catenary.

The present invention is also directed to a golf ball, including a first hemisphere including a plurality of dimples; and a second hemisphere including a plurality of dimples, wherein a first dimple in the first hemisphere includes a first plan shape, a first profile shape, and a first geometric center, the first geometric center being located at a position defined by a first polar angle $\theta_N$ measured from a pole of the first hemisphere; a second dimple in the second hemisphere includes a second plan shape, a second profile shape, and a second geometric center, the second geometric center being located at a position defined by a second polar angle $\theta_S$ measured from a pole of the second hemisphere; the first polar angle $\theta_N$ differs from the second polar angle $\theta_S$ by no more than 3°; the first profile shape is different from the second profile shape and the first and second profile shapes are selected from the group consisting of spherical, catenary, and conical; the first dimple and the second dimple have substantially equal dimple diameters; and the first dimple and the second dimple have substantially identical surface volumes. In this aspect, the geometric center of the first dimple is separated from the geometric center of the second dimple by an offset angle $\gamma$.

In one embodiment, the first profile shape may be spherical and the second profile shape may be catenary. In this aspect, (i) the spherical dimple has an edge angle of about 12.0 degrees to about 15.5 degrees, and (ii) the catenary dimple has a shape factor of about 30 to about 300 and a chord depth of about $2.0\times10^{-3}$ inches to about $6.5\times10^{-3}$ inches. In another embodiment, the first profile shape may be spherical and the second profile shape may be conical. In this aspect, (i) the spherical dimple has an edge angle of about 12.0 degrees to about 15.5 degrees, and (ii) the conical dimple has a saucer ratio of about 0.05 to about 0.75 and an edge angle of about 10.4 degrees to about 14.3 degrees. In still another embodiment, the first profile shape may be conical and the second profile shape may be catenary. In this aspect, (i) the conical dimple has a saucer ratio of about 0.05 to about 0.75 and an edge angle of about 10.4 degrees to about 14.3 degrees, and (ii) the catenary dimple has a shape factor of about 30 to about 300 and a chord depth of about $2.0\times10^{-3}$ inches to about $6.5\times10^{-3}$ inches. In yet another embodiment, the first and second dimples have a dimple diameter ranging from about 0.100 inches to about 0.205 inches.

The present invention is further directed to a golf ball, including a first hemisphere including a plurality of dimples; and a second hemisphere including a plurality of dimples, wherein a first dimple in the first hemisphere includes a first plan shape, a first profile shape, and a first geometric center, the first geometric center being located at a position defined by a first polar angle $\theta_N$ measured from a pole of the first hemisphere; a second dimple in the second hemisphere includes a second plan shape, a second profile shape, and a second geometric center, the second geometric center being located at a position defined by a second polar angle $\theta_S$ measured from a pole of the second hemisphere; the first polar angle $\theta_N$ differs from the second polar angle $\theta_S$ by no more than 3°; the first profile shape is different from the second profile shape and the first and second profile shapes are selected from the group consisting of spherical, catenary, and conical; the first dimple and the second dimple have substantially different dimple diameters and the first dimple has a larger dimple diameter than the second dimple; and the first dimple and the second dimple have substantially identical surface volumes. In this aspect, the first and second dimples have a dimple diameter ranging from about 0.100 inches to about 0.205 inches.

In one embodiment, the first profile shape may be spherical and the second profile shape may be catenary. In this aspect, (i) the spherical dimple has an edge angle of about 12.0 degrees to about 15.5 degrees, and (ii) the catenary dimple has a shape factor of about 30 to about 300 and a chord depth of about $2.3\times10^{-3}$ inches to about $8.4\times10^{-3}$ inches. In another embodiment, the first profile shape may be catenary and the second profile shape may be spherical. In this aspect, (i) the catenary dimple has a shape factor of about 30 to about 300 and a chord depth of about $2.4\times10^{-3}$ inches to about $6.1\times10^{-3}$ inches, and (ii) the spherical dimple has an edge angle of about 12.0 degrees to about 15.5 degrees. In still another embodiment, the first profile shape may be spherical and the second profile shape may be conical. In this aspect, (i) the spherical dimple has an edge angle of about 12.0 degrees to about 15.5 degrees, and (ii) the conical dimple has a saucer ratio of about 0.05 to about 0.75 and an edge angle of about 10.5 degrees to about 16.7 degrees. In yet another embodiment, the first profile shape may be conical and the second profile shape may be spherical. In this aspect, (i) the conical dimple has a saucer ratio of about 0.05 to about 0.75 and an edge angle of about 7.6 degrees to about 13.8 degrees, and (ii) the spherical dimple has an edge angle of about 12.0 degrees to about 15.5 degrees. In still another embodiment, the first profile shape may be conical and the second profile shape may be catenary. In this embodiment, (i) the conical dimple has a saucer ratio of about 0.05 to about 0.75 and an edge angle of about 7.6 degrees to about 13.8 degrees, and (ii) the catenary dimple has a shape factor of about 30 to about 300 and a chord depth of about $2.3\times10^{-3}$ inches to about $8.4\times10^{-3}$ inches. In another embodiment, the first profile shape is catenary and the second profile shape is conical. For example, in this embodiment, (i) the catenary dimple has a shape factor of about 30 to about 300 and a chord depth of about $2.4\times10^{-3}$ inches to about $6.1\times10^{-3}$ inches, and (ii) the conical dimple has a saucer ratio of about 0.05 to about 0.75 and an edge angle of about 10.5 degrees to about 16.7 degrees.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

The present invention provides golf balls with opposing hemispheres that differ from one another, e.g., by having different dimple plan shapes or profiles, while also achieving flight symmetry and overall satisfactory flight performance. In this aspect, the present invention provides golf balls that permit a multitude of unique appearances, while also conforming to the USGA's requirements for overall distance and flight symmetry. The present invention is also directed to methods of developing the dimple geometries applied to the opposing hemispheres, as well as methods of making the finished golf balls with the inventive dimple patterns applied thereto.

In particular, finished golf balls according to the present invention have opposing hemispheres with dimple geometries that differ from one another in that the dimples on one hemisphere have different plan shapes (the shape of the dimple in a plan view), different profile shapes (the shape of the dimple cross-section, as seen in a profile view of a plane extending transverse to the center of the golf ball and through the geometric center of the dimple), or a combination thereof, as compared to dimples on an opposing hemisphere. Despite the difference the dimples on one hemisphere have dimple volumes that are substantially similar to the dimple volumes on an opposing hemisphere.

Though the dimple geometry on the opposing hemispheres are designed to differ in that the plan shape and/or profile shape of the dimples in one hemisphere are different from the plan shape and/or profile shape of the dimples in another hemisphere, the hemispheres nonetheless have the same dimple arrangement or pattern. In other words, the dimples in one hemisphere are positioned such that the locations of their geometric centers are substantially identical to the locations of the geometric centers of the dimples in the other hemisphere in terms of polar angles θ (measuring the rotational offset of an individual dimple from the polar axis of its respective hemisphere) and offset angles γ (measuring the rotational offset between two corresponding dimples, as rotated around the equator of the golf ball).

Dimple Arrangement

Figure 1:
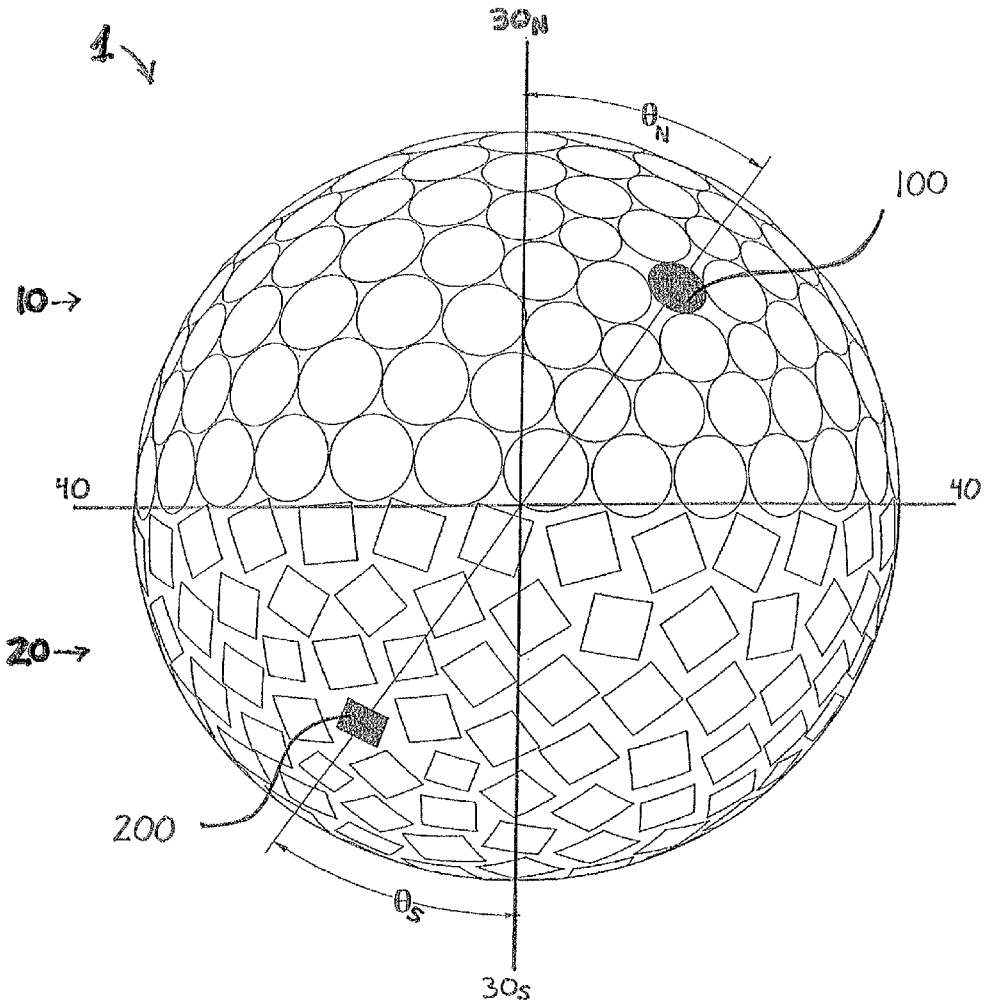
FIG. 1 depicts an equatorial, profile view of a golf ball according to one embodiment of the invention, illustrating the polar angles ($\theta_N$ and $\theta_S$) of two corresponding dimples in two different hemispheres of a golf ball according to the present invention.
Figure 2:
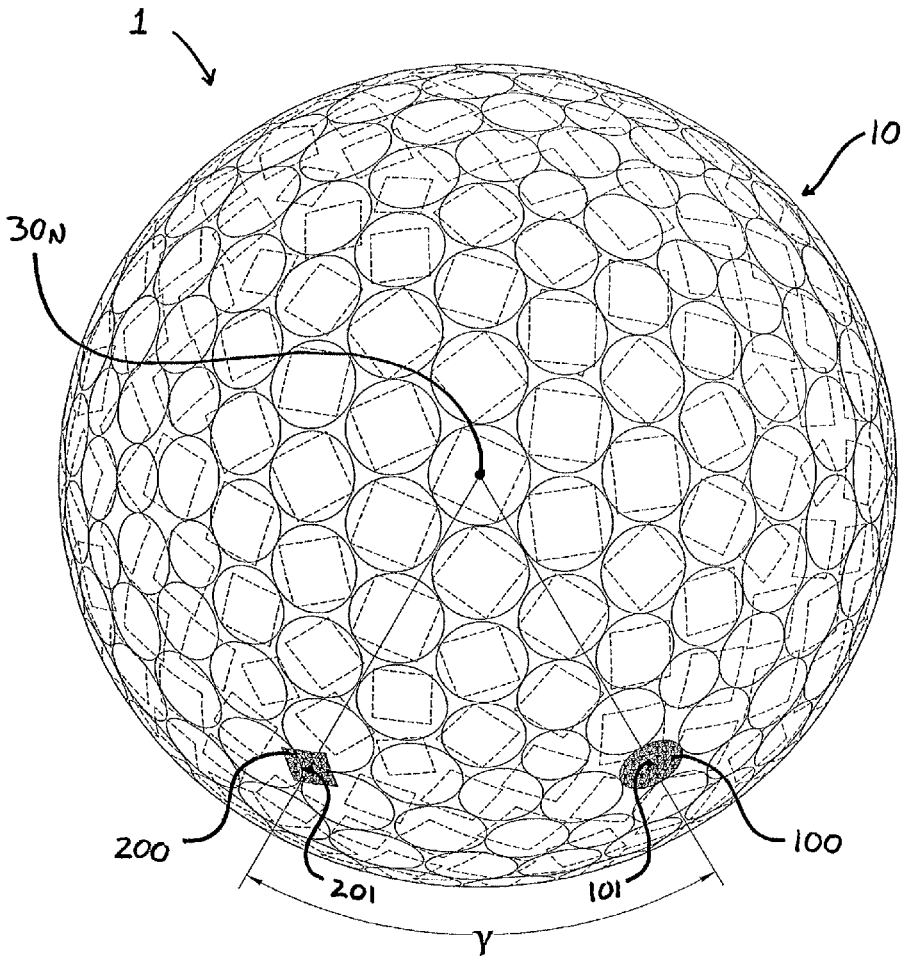
FIG. 2 depicts a polar, plan view of the golf ball in FIG. 1, showing the rotation offset angle $\gamma$ between the two corresponding dimples, as measured around the equator of the ball.

A non-limiting example of suitable dimple geometries for use on a golf ball according to the present invention is shown in FIGS. 1-2. In particular, in one embodiment, a first hemisphere may have a first dimple geometry and a second hemisphere may have a second dimple geometry, where the first and second dimple geometries differ from each other. In this aspect, the first and second dimple geometries may each have a plurality of corresponding dimples each offset from the polar axis of the respective hemispheres by a predetermined angle. The geometric centers of the corresponding dimples may be separated by a predetermined angle that is equal to the rotational offset between the two corresponding dimples as measured around the equator of the golf ball.

For example, as shown in FIG. 1, for each dimple 100 in a first hemisphere 10 of the golf ball 1 (e.g., a "northern" hemisphere 10) there is a corresponding dimple 200 in a second hemisphere 20 (e.g., an opposing "southern" hemisphere 20). In each pair of corresponding dimples 100/200, the dimple 100 in the first hemisphere 10 is offset from the polar axis $\mathbf{30}_N$ of the first hemisphere 10 by a polar angle $\theta_N$, and the dimple 200 in the second hemisphere 20 is offset from the polar axis $\mathbf{30}_S$ of the second hemisphere 20 by a polar angle $\theta_S$; with the two polar angles being equal to one another (i.e., $\theta_N=\theta_S$). Though the polar angles ($\theta_N$, $\theta_S$) of corresponding dimples are preferably equal to one another, the polar angles may differ by about 1° and up to about 3°.

As shown in FIG. 2, in each pair of corresponding dimples 100/200, the geometric centers 101/201 of the dimples are separated from one another by an offset angle γ, which represents a rotational offset between the two corresponding dimples 100/200 as measured around the equator 40 of the golf ball 1. In each pair of corresponding dimples 100/200, the offset angles ($\gamma_1$, $\gamma_2$, γ3, etc.) are preferably substantially equal (e.g., $\gamma_1=\gamma_2=\gamma_3$). However, the offset angles may differ by about 1° and up to about 3°.

As discussed below, at least one of the corresponding dimple pairs from the plurality of corresponding dimples on each hemisphere differ in plan shape, profile, or a combination thereof. In other words, as shown in FIG. 1, the plan shapes of a corresponding dimple pair (100/200) may be different whereas other corresponding dimple pairs need not differ (not shown in FIG. 1). In one embodiment, at least about 50 percent of the corresponding dimple pairs from the plurality of corresponding dimples on each hemisphere differ from each other in plan shape, profile, or a combination thereof. In another embodiment, at least 75 percent of the corresponding dimple pairs from the plurality of corresponding dimples on each hemisphere differ from each other in plan shape, profile, or a combination thereof. In still another embodiment, all of the corresponding dimple pairs from the plurality of corresponding dimples on each hemisphere differ from each other in plan shape, profile, or a combination thereof. For example, as shown in FIG. 1, each dimple in the first hemisphere 10 has a plan shape that differs from its mate in the second hemisphere 20. Accordingly, it should be understood that any discussion relating to a corresponding dimple pair 100/200 is intended to be representative of a portion of or all of the remaining corresponding dimple pairs in the plurality of dimples, when more than at least one corresponding dimple pair differs.

Dimple Plan Shapes

As briefly discussed above, one way to achieve differing dimple geometries with the same dimple arrangement on opposing hemispheres in accordance with the present invention is to include corresponding dimples that differ in plan shape. Thus, in one aspect of the present invention, the dimples in two hemispheres are considered different from one another if, in a given pair of corresponding dimples, a dimple in one hemisphere has a different plan shape than the plan shape of the corresponding dimple in the other hemisphere. In another aspect of the present invention, the dimples in two hemispheres are considered different from one another if, in a given pair of corresponding dimples, a dimple in one hemisphere has a different plan shape orientation than the plan shape orientation of the corresponding dimple in the other hemisphere.

In one embodiment, at least about 25 percent of the corresponding dimples in the opposing hemispheres have different plan shapes. In another embodiment, at least about 50 percent of the corresponding dimples in the opposing hemispheres have different plan shapes. In yet another embodiment, at least about 75 percent of the corresponding dimples in the opposing hemispheres have different plan shapes. In still another embodiment, all of the corresponding dimples in the opposing hemispheres have different plan shapes.

The plan shapes (or plan shape orientations) of two dimples are considered different from one another if a comparison of the overlaid dimples yields a mean absolute residual $\bar{r}$, over a number of n equally spaced points around the geometric centers of the overlaid dimples, that is significantly different from zero. In other words, the distribution of the residuals are compared using a t-distribution having an average of zero to test for equivalence and, as such, the range of t-values that is considered significantly different from zero is dependent on the number of intersection lines n used. For example, as shown in the non-limiting T-Table below, if the number of intersection lines is 30, the t-value must be greater than 1.699 for the absolute residual $\bar{r}$ to be considered significantly different from zero. Similarly, if the number of intersection lines is 200, the t-value must be greater than 1.653 for the absolute residual $\bar{r}$ to be considered significantly different from zero.

TABLE 1

T-Table

| Intersection Lines | Degrees of Freedom | Critical T-value |
|---|---|---|
| 30 | 29 | 1.699 |
| 31 | 30 | 1.697 |
| 32 | 31 | 1.696 |
| 33 | 32 | 1.694 |
| 34 | 33 | 1.692 |
| 35 | 34 | 1.691 |
| 36 | 35 | 1.690 |
| 37 | 36 | 1.688 |
| 38 | 37 | 1.687 |
| 39 | 38 | 1.686 |
| 40 | 39 | 1.685 |
| 41 | 40 | 1.684 |
| 42 | 41 | 1.683 |
| 43 | 42 | 1.682 |
| 44 | 43 | 1.681 |
| 45 | 44 | 1.680 |
| 46 | 45 | 1.679 |
| 47 | 46 | 1.679 |
| 48 | 47 | 1.678 |
| 49 | 48 | 1.677 |
| 50 | 49 | 1.677 |
| 51 | 50 | 1.676 |
| 52 | 51 | 1.675 |
| 53 | 52 | 1.675 |
| 54 | 53 | 1.674 |
| 55 | 54 | 1.674 |
| 56 | 55 | 1.673 |
| 57 | 56 | 1.673 |
| 58 | 57 | 1.672 |
| 59 | 58 | 1.672 |
| 60 | 59 | 1.671 |
| 61 | 60 | 1.671 |
| 62 | 61 | 1.670 |
| 63 | 62 | 1.670 |
| 64 | 63 | 1.669 |
| 65 | 64 | 1.669 |
| 66 | 65 | 1.669 |
| 67 | 66 | 1.668 |
| 68 | 67 | 1.668 |
| 69 | 68 | 1.668 |
| 70 | 69 | 1.667 |
| 71 | 70 | 1.667 |
| 72 | 71 | 1.667 |
| 73 | 72 | 1.666 |
| 74 | 73 | 1.666 |
| 75 | 74 | 1.666 |
| 76 | 75 | 1.665 |
| 77 | 76 | 1.665 |
| 78 | 77 | 1.665 |
| 79 | 78 | 1.665 |
| 80 | 79 | 1.664 |
| 81 | 80 | 1.664 |

TABLE 1-continued

| T-Table | | |
|---|---|---|
| Intersection Lines | Degrees of Freedom | Critical T-value |
| 82 | 81 | 1.664 |
| 83 | 82 | 1.664 |
| 84 | 83 | 1.663 |
| 85 | 84 | 1.663 |
| 86 | 85 | 1.663 |
| 87 | 86 | 1.663 |
| 88 | 87 | 1.663 |
| 89 | 88 | 1.662 |
| 90 | 89 | 1.662 |
| 91 | 90 | 1.662 |
| 92 | 91 | 1.662 |
| 93 | 92 | 1.662 |
| 94 | 93 | 1.661 |
| 95 | 94 | 1.661 |
| 96 | 95 | 1.661 |
| 97 | 96 | 1.661 |
| 98 | 97 | 1.661 |
| 99 | 98 | 1.661 |
| 100 | 99 | 1.660 |
| 101 | 100 | 1.660 |
| 102 | 101 | 1.660 |
| 103 | 102 | 1.660 |
| 104 | 103 | 1.660 |
| 105 | 104 | 1.660 |
| 106 | 105 | 1.659 |
| 107 | 106 | 1.659 |
| 108 | 107 | 1.659 |
| 109 | 108 | 1.659 |
| 110 | 109 | 1.659 |
| 111 | 110 | 1.659 |
| 112 | 111 | 1.659 |
| 113 | 112 | 1.659 |
| 114 | 113 | 1.658 |
| 115 | 114 | 1.658 |
| 116 | 115 | 1.658 |
| 117 | 116 | 1.658 |
| 118 | 117 | 1.658 |
| 119 | 118 | 1.658 |
| 120 | 119 | 1.658 |
| 121 | 120 | 1.658 |
| 122 | 121 | 1.658 |
| 123 | 122 | 1.657 |
| 124 | 123 | 1.657 |
| 125 | 124 | 1.657 |
| 126 | 125 | 1.657 |
| 127 | 126 | 1.657 |
| 128 | 127 | 1.657 |
| 129 | 128 | 1.657 |
| 130 | 129 | 1.657 |
| 131 | 130 | 1.657 |
| 132 | 131 | 1.657 |
| 133 | 132 | 1.656 |
| 134 | 133 | 1.656 |
| 135 | 134 | 1.656 |
| 136 | 135 | 1.656 |
| 137 | 136 | 1.656 |
| 138 | 137 | 1.656 |
| 139 | 138 | 1.656 |
| 140 | 139 | 1.656 |
| 141 | 140 | 1.656 |
| 142 | 141 | 1.656 |
| 143 | 142 | 1.656 |
| 144 | 143 | 1.656 |
| 145 | 144 | 1.656 |
| 146 | 145 | 1.655 |
| 147 | 146 | 1.655 |
| 148 | 147 | 1.655 |
| 149 | 148 | 1.655 |
| 150 | 149 | 1.655 |
| 151 | 150 | 1.655 |
| 152 | 151 | 1.655 |
| 153 | 152 | 1.655 |
| 154 | 153 | 1.655 |
| 155 | 154 | 1.655 |
| 156 | 155 | 1.655 |

TABLE 1-continued

| T-Table | | |
|---|---|---|
| Intersection Lines | Degrees of Freedom | Critical T-value |
| 157 | 156 | 1.655 |
| 158 | 157 | 1.655 |
| 159 | 158 | 1.655 |
| 160 | 159 | 1.654 |
| 161 | 160 | 1.654 |
| 162 | 161 | 1.654 |
| 163 | 162 | 1.654 |
| 164 | 163 | 1.654 |
| 165 | 164 | 1.654 |
| 166 | 165 | 1.654 |
| 167 | 166 | 1.654 |
| 168 | 167 | 1.654 |
| 169 | 168 | 1.654 |
| 170 | 169 | 1.654 |
| 171 | 170 | 1.654 |
| 172 | 171 | 1.654 |
| 173 | 172 | 1.654 |
| 174 | 173 | 1.654 |
| 175 | 174 | 1.654 |
| 176 | 175 | 1.654 |
| 177 | 176 | 1.654 |
| 178 | 177 | 1.654 |
| 179 | 178 | 1.653 |
| 180 | 179 | 1.653 |
| 181 | 180 | 1.653 |
| 182 | 181 | 1.653 |
| 183 | 182 | 1.653 |
| 184 | 183 | 1.653 |
| 185 | 184 | 1.653 |
| 186 | 185 | 1.653 |
| 187 | 186 | 1.653 |
| 188 | 187 | 1.653 |
| 189 | 188 | 1.653 |
| 190 | 189 | 1.653 |
| 191 | 190 | 1.653 |
| 192 | 191 | 1.653 |
| 193 | 192 | 1.653 |
| 194 | 193 | 1.653 |
| 195 | 194 | 1.653 |
| 196 | 195 | 1.653 |
| 197 | 196 | 1.653 |
| 198 | 197 | 1.653 |
| 199 | 198 | 1.653 |
| 200 | 199 | 1.653 |

In order to make the overlaying comparison, dimples in a pair of corresponding dimples must be aligned with one another. For example, the dimple in the southern hemisphere is transformed γ degrees about the polar axis such that the centroid of the southern hemisphere dimple lies in a common plane (P) as the centroid of the northern hemisphere dimple and the golf ball centroid. The southern hemisphere dimple is then transformed by an angle of [2*(90−θ)] degrees about an axis that is normal to plane P and passes though the golf ball centroid. The plan shape is then rotated by 180 degrees about an axis connecting the dimple centroid to the golf ball centroid. These transformations will result in the plan shapes of the southern and northern dimples, in a pair of corresponding dimples, to be properly oriented in the same plane such that differences between their plan shape and plan shape orientation can be determined by calculating the absolute residual. In another example, where the plan shapes of the dimples are not axially symmetric, the dimples may be aligned with one another by positioning the two dimples relative to one another such that a single axis passes through the centroid of each plan shape.

Figure 3:
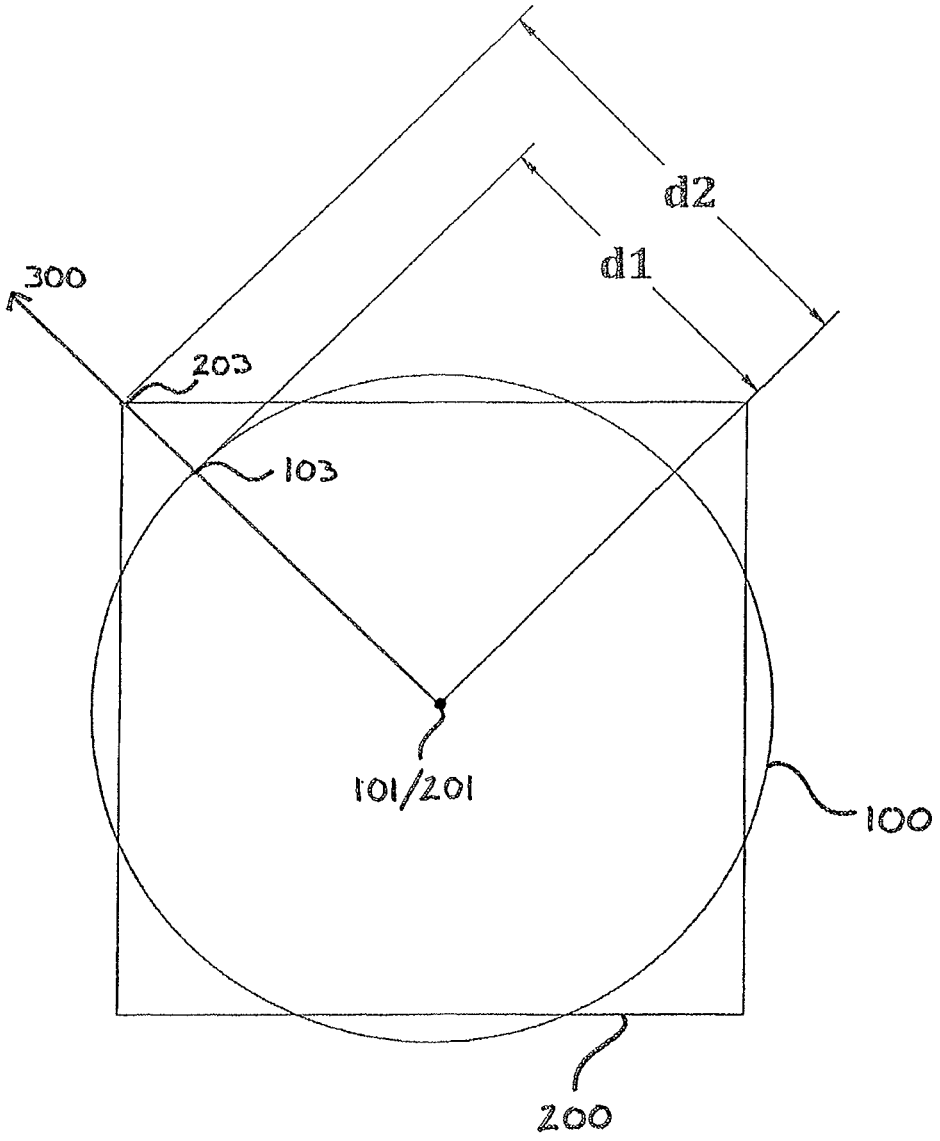
FIG. 3 depicts an overlaying comparison of the plan shapes of the two corresponding dimples in FIG. 1, for calculating an absolute residual via a first intersection line.

An absolute residual r is determined by overlaying the plan shapes of two dimples 100/200 with the geometric centers 101/201 of the two plan shapes aligned with one another, as shown in FIG. 3. An intersection line 300 is made to extend from the aligned geometric centers 101/201 in any chosen direction, with the intersection line 300 extending a sufficient length to intersect a perimeter point 103 of the first dimple 100, as well as a perimeter point 203 of the second dimple 200. A distance $d_1$ is then measured from the geometric centers 101/201 to the perimeter point 103 of the first dimple 100; and a distance $d_2$ is measured from the geometric centers 101/201 to the perimeter point 203 of the second dimple 200. An absolute residual r is then calculated as the absolute value of the difference between the two measured distances, such that $r=|d_1-d_2|$.

Figure 4:
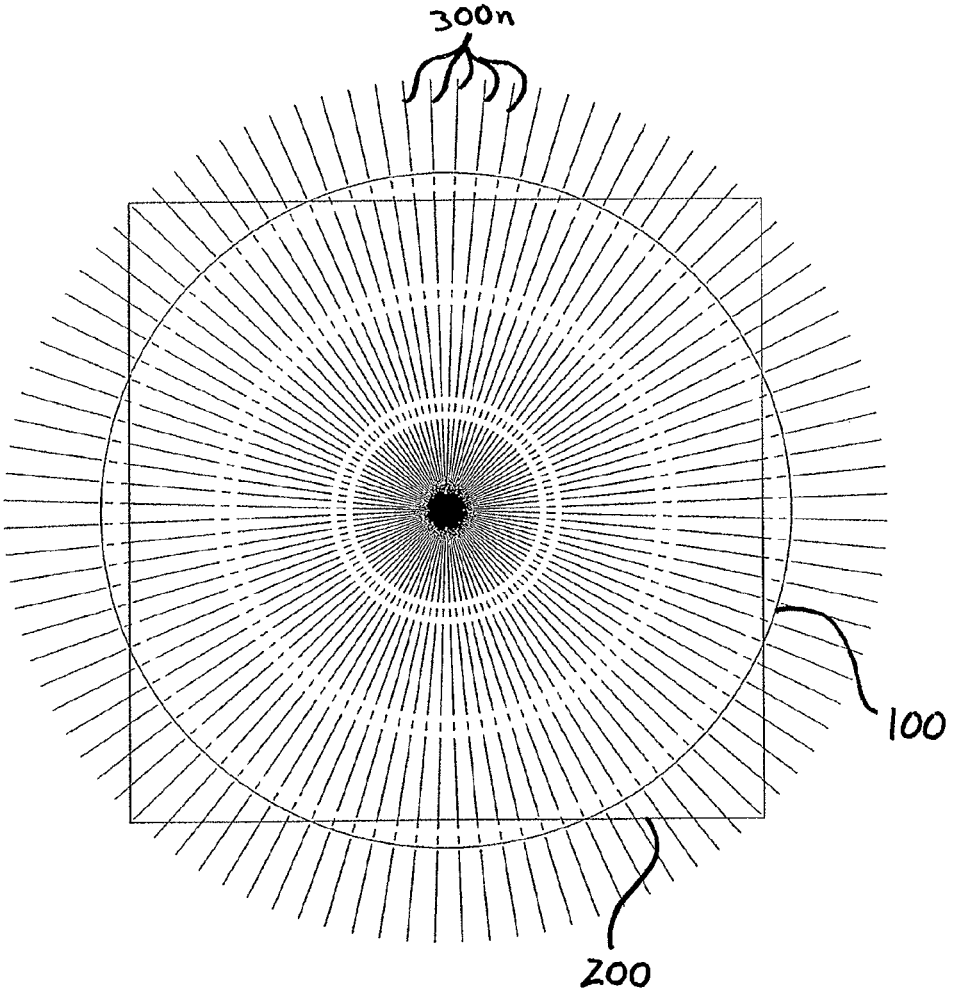
FIG. 4 depicts an overlaying comparison of the plan shapes of the two corresponding dimples in FIG. 1, for calculating a mean absolute residual via a plurality of intersection lines.

A mean absolute residual $\bar{r}$ is calculated by calculating an absolute residual r over a number of n equally spaced intersection lines $\mathbf{300}_n$, and then averaging the separately calculated absolute residuals r. FIG. 4 shows one simplified example of a number of n equally spaced intersection lines $\mathbf{300}_n$ in an overlaying comparison of plan shapes. As seen in FIG. 4, a number (n) of intersection lines $\mathbf{300}_n$ are equally spaced over a 360° range around the geometric centers 101/201, with each intersection line $\mathbf{300}_n$ made to extend a sufficient length from the geometric centers 101/201 to intersect both a perimeter point 103 of the first dimple 100 as well as a perimeter point 203 of the second dimple 200. Preferably, the intersection lines $\mathbf{300}_n$ are spaced from one another such that there is an identical angle $\theta_L$ between each adjacent pair of intersection lines $\mathbf{300}_n$, the angle $\theta_L$ measuring ($1.8° \leq \theta_L \leq 12°$) and being selected based on the number of intersection lines $\mathbf{300}_n$. For each intersection line $\mathbf{300}_n$, distances $d_1$ and $d_2$ are measured and an absolute residual r is calculated as the absolute value of the difference between the two distances, with $r=|d_1-d_2|$, such that there is acquired a total number (n) of absolute residuals r. The number (n) of absolute residuals r are then averaged to yield a mean absolute residual $\bar{r}$. The number (n) of intersection lines $\mathbf{300}_n$, and hence the number of absolute residuals r, should be greater than or equal to about thirty but less than or equal to about two hundred.

A residual standard deviation $S_r$ is calculated for the group of (n) residuals r, via the following equation:

$$S_r = \sqrt{\frac{1}{n-1}\sum_{i=1}^{n}(r_i-\bar{r})^2}$$

A t-statistic ($t_j$) is then calculated according to the following equation:

$$t_j = \frac{\bar{r}}{\frac{S_r}{\sqrt{n}}}$$

The calculated t-statistic ($t_j$) is compared to a critical t value from a t-distribution with (n−1) degrees of freedom and an alpha value of 0.05, via the following equation:

$$t_j > t_{\alpha,n-1}$$

If the foregoing equation comparing $t_j$ and t is logically true, then the overlaid plan shapes are considered different.

The foregoing procedure may be repeated for any dimple pair on the ball that could be considered different. However, as one of ordinary skill in the art would readily understand, and because not all dimple pairs on the ball will have different shapes, the foregoing procedure would only be applied to dimple pairs with a different plan shape. In one embodiment, the foregoing procedure is performed only until dimples in a single pair of corresponding dimples are determined to be different, with the understanding that identification of different dimples within even a single pair of corresponding dimples is sufficient to conclude that the two hemispheres on which the dimples are located have different dimple geometries.

The plan shape of each dimple in a corresponding dimple pair may be any shape within the context of the above disclosure. In one embodiment, the plan shape may be any one of a circle, square, triangle, rectangle, oval, or other geometric or non-geometric shape providing that the corresponding dimple in another hemisphere differs. By way of example, in a pair of corresponding dimples, the dimple in the first hemisphere may be a circle and the corresponding dimple in the second hemisphere may be a square (as generally shown in FIG. 1). In another embodiment, the plan shape of two dimples in a pair of corresponding dimples may be generally the same (i.e., each dimple in a corresponding dimple pair is the same general shape of a circle, square, oval, etc.), though the two dimples may nonetheless have different plan shapes due to a difference in size.

Dimple Profile

Another way to achieve differing dimple geometries with the same dimple arrangement on opposing hemispheres in accordance with the present invention is to include corresponding dimples that differ in profile shape. Thus, in another embodiment, the dimples on opposing hemispheres are considered different from one another if, in a pair of corresponding dimples, the profile shapes of the corresponding dimples differ from one another. The profile shapes of two dimples are considered different from one another if an overlaying comparison of the profile shapes of the two dimples yields a mean absolute residual $\bar{r}$, over a number of (n+1) equally spaced points along the overlaid profile shapes, that is significantly different from zero.

In one embodiment, at least about 25 percent of the corresponding dimples in the opposing hemispheres have different profile shapes. In another embodiment, at least about 50 percent of the corresponding dimples in the opposing hemispheres have different profile shapes. In yet another embodiment, at least about 75 percent of the corresponding dimples in the opposing hemispheres have different profile shapes. In still another embodiment, all of the corresponding dimples in the opposing hemispheres have different profile shapes.

Figure 5:
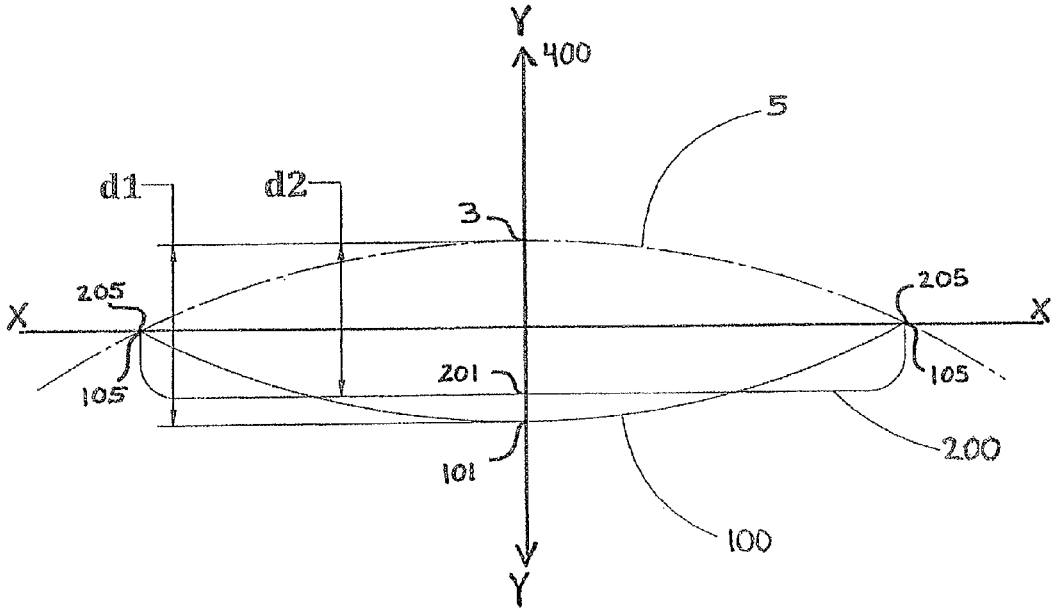
FIG. 5 depicts an overlaying comparison of the profile shapes of the two corresponding dimples in FIG. 1, for calculating an absolute residual via a first intersection line.

An absolute residual r is determined by overlaying the profile shapes of two dimples 100/200, as shown in FIG. 5. The dimple cross-sections used in this analysis must be cross-sections taken along planes that pass through the geometric centers 101/201 of the respective dimples 100/200. If the dimple is axially symmetric, then the dimple cross-section may be taken along any plane that runs through the geometric center. However, if the dimple is not axially symmetric, then the dimple cross-section is taken along a plane passing through the geometric center of that dimple which produces the widest dimple profile shape in a cross-section view. In one embodiment, in the case where a dimple is not axially symmetric, multiple mean residual calculations are conducted and at least one is significantly different than zero. In another embodiment at least five mean residuals are calculated and at least one is significantly different than zero.

The dimple profile shapes are overlaid with one another such that the geometric centers 101/201 of the two dimples 100/200 are aligned on a common vertical axis Y-Y, and such that the peripheral edges 105/205 of the two profile shapes (i.e., the edges of the dimple perimeter that intersect the outer surface of the golf ball 1) are aligned on a common horizontal axis X-X, as shown in FIG. 5. An initial intersection line 400 is made to extend from the center of the golf ball 1 through both geometric centers 101/201 (i.e., the initial intersection line 400 is drawn to extend along the common vertical axis Y-Y). The initial intersection line 400 is made to extend a sufficient length to also pass through a phantom point 3 where the initial intersection line 400 would intersect a phantom surface 5 of the golf ball 1. A distance $d_1$ is then measured from the point where the initial intersection line 400 intersects the profile shape of the first dimple 100 (i.e., the geometric center 101) to the point where the initial intersection line 400 intersects the phantom surface 5 (i.e., the phantom point 3). Similarly, a distance $d_2$ is measured from the point where the initial intersection line 400 intersects the profile shape of the second dimple 200 (i.e., the geometric center 201) to the point where the initial intersection line 400 intersects the phantom surface 5 (i.e., the phantom point 3). An absolute residual r is then calculated as the absolute value of the difference between the two measured distances, such that $r=|d_1-d_2|$.

Figure 6:
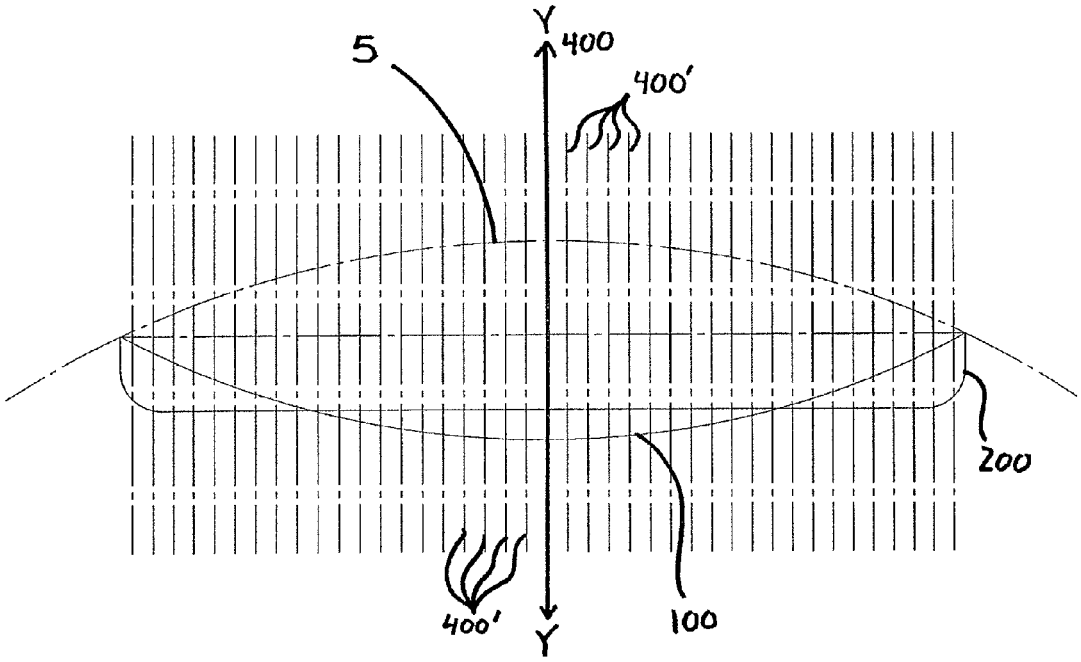
FIG. 6 depicts an overlaying comparison of the profile shapes of the two corresponding dimples in FIG. 1, for calculating a mean absolute residual via a plurality of intersection lines.

A mean absolute residual r is calculated by calculating an absolute residual r over a number (n+1) of equally spaced intersection lines 400/400', and averaging the separately calculated absolute residuals r. FIG. 6 shows one simplified example of a number (n+1) of equally spaced intersection lines 400/400' in an overlaying comparison of profile shapes. As seen in FIG. 6, a number of (n) additional intersection lines 400' are equally spaced along the length of the overlaid profile shapes of the corresponding dimples 100/200, with the (n) additional intersection lines 400' arranged symmetrically about the initial intersection line 400, such that there are (n/2) additional intersection lines 400' on each side of the initial intersection line 400, and such that none of the additional intersection lines 400' intersect a point on the peripheral edges 105/205, where there profile shapes contact the surface of the golf ball 1. Each intersection line 400' is made to extend a sufficient length to pass through a point 107 on the profile shape of the first dimple 100, a point 207 on the profile shape of the second dimple 200, and a phantom point 4 on the phantom surface 5 of the golf ball 1. For each intersection line 400', distances $d_1$ and $d_2$ are measured and an absolute residual r is calculated as the absolute value of the difference between the two distances, with $r=|d_1-d_2|$, such that there is acquired a total number (n+1) of absolute residuals r. The number (n+1) of absolute residuals r are then averaged to yield a mean absolute residual $\bar{r}$. The total number (n+1) of intersection lines 400/400', and hence the number of absolute residuals r, should be greater than or equal to about thirty-one but less than or equal to about two hundred one.

A residual standard deviation $S_r$ is calculated for the group of (n+1) residuals r, via the following equation:

$$S_r = \sqrt{\frac{1}{n}\sum_{i=1}^{n}(r_i - \bar{r})^2}$$

A t-statistic ($t_j$) is calculated according to the following equation:

$$t_j = \bar{r}\frac{S_r}{\sqrt{n+1}}$$

The calculated t-statistic ($t_j$) is compared to a critical t value from a t-distribution with ((n+1)−1) degrees of freedom and an alpha value of 0.05, via the following equation:

$$t_j > t_{\alpha,n}$$

If the foregoing equation comparing $t_j$ and t is logically true, then the overlaid profile shapes are considered different.

The foregoing procedure may be repeated for any dimple pair on the ball that could be considered to have different profile shapes. However, as one of ordinary skill in the art would appreciate, and because not all dimple pairs on the ball will have different profile shapes, the foregoing procedure would only be applied to dimple pairs with a different profile shape. In one embodiment, the foregoing procedure is performed only until dimples in a single pair of corresponding dimples are determined to be different (in plan and/or profile shape), with the understanding that identification of different dimples within even a single pair of corresponding dimples is sufficient to conclude that the two hemispheres on which the dimples are located have different dimple geometries.

The cross-sectional profile of the dimples according to the present invention may be based on any known dimple profile shape that works within the context of the above disclosure. In one embodiment, the profile of the dimples corresponds to a curve. For example, the dimples of the present invention may be defined by the revolution of a catenary curve about an axis, such as that disclosed in U.S. Pat. Nos. 6,796,912 and 6,729,976, the entire disclosures of which are incorporated by reference herein. In another embodiment, the dimple profiles correspond to parabolic curves, ellipses, spherical curves, saucer-shapes, truncated cones, and flattened trapezoids.

The profile of the dimple may also aid in the design of the aerodynamics of the golf ball. For example, shallow dimple depths, such as those in U.S. Pat. No. 5,566,943, the entire disclosure of which is incorporated by reference herein, may be used to obtain a golf ball with high lift and low drag coefficients. Conversely, a relatively deep dimple depth may aid in obtaining a golf ball with low lift and low drag coefficients.

The dimple profile may also be defined by combining a spherical curve and a different curve, such as a cosine curve, a frequency curve or a catenary curve, as disclosed in U.S. Patent Publication No. 2012/0165130, which is incorporated in its entirety by reference herein. Similarly, the dimple profile may be defined by the superposition of two or more curves defined by continuous and differentiable functions that have valid solutions. For example, in one embodiment, the dimple profile is defined by combining a spherical curve and a different curve. In another embodiment, the dimple profile is defined by combining a cosine curve and a different curve. In still another embodiment, the dimple profile is defined by the superposition of a frequency curve and a different curve. In yet another embodiment, the dimple profile is defined by the superposition of a catenary curve and different curve.

As discussed above, the present invention contemplates a first hemisphere having a first dimple profile geometry and a second hemisphere having a second dimple profile geometry, where the first and second dimple profile geometries differ from each other. In this aspect, the golf balls of the present invention have hemispherical dimple layouts that are different in dimple profile shape (for example, conical and catenary dimple profile shapes may be used on opposing dimples in a dimple pairing), but maintain dimple volumes that are substantially similar to the dimple volumes on an opposing hemisphere.

Conical Dimple Profile Opposing Catenary Dimple Profile

Figure 13A:
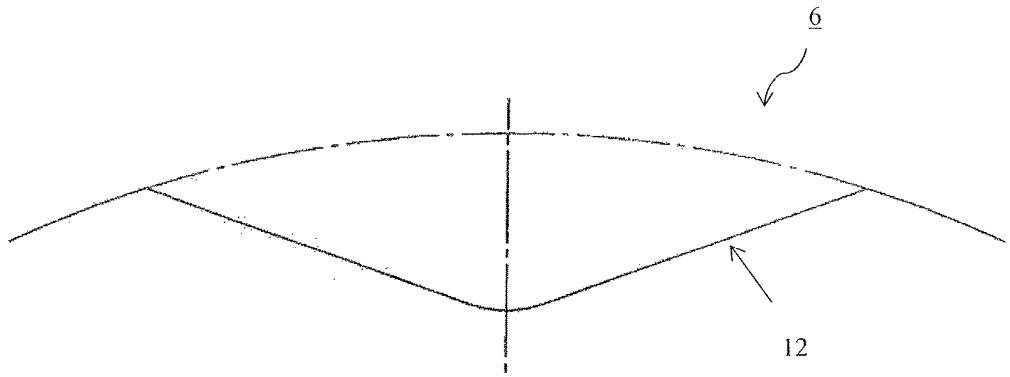
FIG. 13*a-c* depict cross-sectional views of various dimple profiles contemplated by the present invention.

For example, in one embodiment, the present invention contemplates a first hemisphere including dimples having a conical dimple profile shape and a second, opposing hemisphere including dimples having a dimple profile shape defined by a catenary curve. In this embodiment, the first hemisphere includes dimples having a conical dimple profile shape. The present invention contemplates dimples having a conical dimple profile shape such as those disclosed in U.S. Pat. No. 8,632,426 and U.S. Publication No. 2014/0135147, the entire disclosures of which are incorporated by reference herein. FIG. 13A shows a cross-sectional view of a dimple 6 having a conical profile 12. The conical profile is defined by three parameters: dimple diameter ($D_D$), edge angle (EA), and saucer ratio (SR). The edge angle (EA) is defined as the angle between a first tangent line at the conical edge of the dimple profile and a second tangent line at the phantom ball surface, while the saucer ratio (SR) measures the ratio of the diameter of the spherical cap at the bottom of the dimple to the dimple diameter.

Figure 13B:
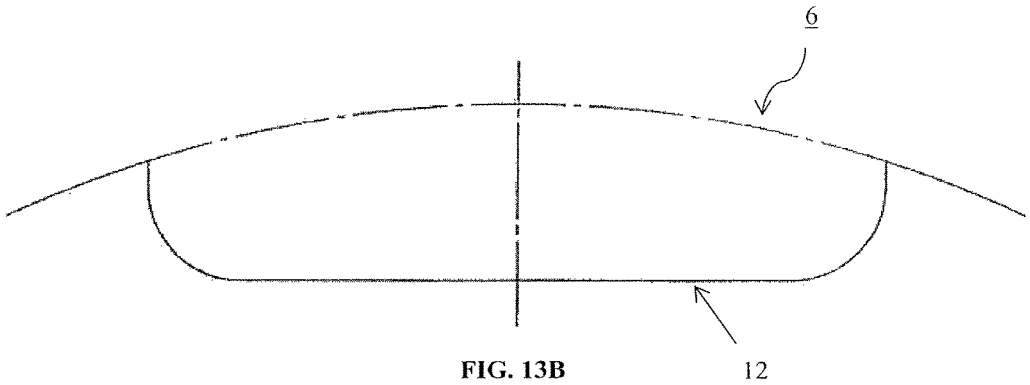

The second hemisphere includes dimple profiles defined by a catenary curve. The present invention contemplates dimple profiles defined by a catenary curve such as those disclosed in U.S. Pat. No. 7,887,439, the entire disclosure of which is incorporated by reference herein. FIG. 13B shows a cross-sectional view of a dimple 6 having a catenary profile. The catenary curve used to define a golf ball dimple is a hyperbolic cosine function in the form of:

$$y = \frac{d_c(\cosh(sf * x) - 1)}{\cosh\left(sf * \frac{D}{2}\right) - 1} \quad (1)$$

where: y is the vertical direction coordinate with 0 at the bottom of the dimple and positive upward (away from the center of the ball);

x is the horizontal (radial) direction coordinate, with 0 at the center of the dimple;

sf is a shape factor (also called shape constant);

$d_c$ is the chord depth of the dimple; and

D is the diameter of the dimple.

The "shape factor," sf, is an independent variable in the mathematical expression described above for a catenary curve. The use of a shape factor in the present invention provides an expedient method of generating alternative dimple profiles for dimples with fixed diameters and depth. For example, the shape factor may be used to independently alter the volume ratio ($V_r$) of the dimple while holding the dimple depth and diameter fixed. The "chord depth," $d_c$, represents the maximum dimple depth at the center of the dimple from the dimple chord plane.

The present invention contemplates dimple diameters for both profiles (i.e., for both the conical dimples and the catenary dimples) of about 0.100 inches to about 0.205 inches. In one embodiment, the dimple diameters are about 0.115 inches to about 0.185 inches. In another embodiment, the dimple diameters are about 0.125 inches to about 0.175 inches. In still another embodiment, the dimple diameters are about 0.130 inches to about 0.155 inches.

In this aspect of the present invention, when the first hemisphere includes conical dimples and the second hemisphere includes catenary dimples, the corresponding dimples in each pair may have substantially equal dimple diameters. By the term, "substantially equal," it is meant a difference in dimple diameter for a given pair of less than about 0.005 inches. For example, in one embodiment, the difference in dimple diameter for a given pair is less than about 0.003 inches. In another embodiment, the difference in dimple diameter for a given pair is less than about 0.0015 inches.

In this embodiment, the catenary dimples may have shape factors (sf) between about 30 and about 300. In another embodiment, the catenary dimples have shape factors (sf) between about 50 and about 250. In still another embodiment, the catenary dimples have shape factors (sf) between about 75 and about 225. In yet another embodiment, the catenary dimples have shape factors (sf) between about 100 and 200.

Figure 14A:
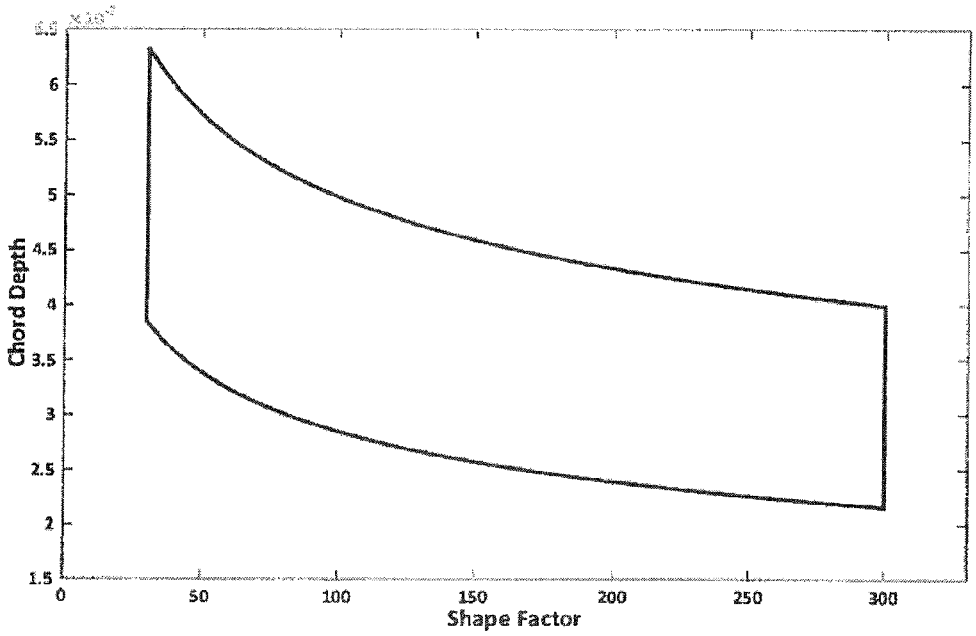
FIG. 14*a* is a graphical representation showing the relationship between chord depths and shape factors of catenary dimples according to one embodiment of the present invention.

The chord depths ($d_c$) of the catenary dimples are related to the above-described shape factors (sf) as defined by the ranges shown in FIG. 14A. As shown in FIG. 14A, generally as the shape factor (sf) increases, the chord depth ($d_c$) decreases. For example, as illustrated in FIG. 14A, catenary dimples having a shape factor of 50 have a chord depth ranging from about $3.8\times10^{-3}$ inches to about $6.3\times10^{-3}$ inches. In another embodiment, catenary dimples having a shape factor of 150 have a chord depth ranging from about $2.6\times10^{-3}$ inches to about $4.6\times10^{-3}$ inches. In still another embodiment, catenary dimples having a shape factor of 250 have a chord depth ranging from about $2.3\times10^{-3}$ inches to about $4.3\times10^{-3}$ inches.

In this aspect, the chord depth of the catenary dimples may also be related to the above-described shape factors as defined by the following equation:

$$\frac{0.0090}{\sqrt[4]{sf}} \le d_c \le \frac{0.0125}{\sqrt[5]{sf}} \quad (2)$$

where $d_c$ represents the chord depth and sf represents the shape factor. Accordingly, the catenary dimples may have a chord depth ranging from about $2.0\times10^{-3}$ inches to about $6.5\times10^{-3}$ inches. In another embodiment, the catenary dimples may have a chord depth ranging from about $2.5\times10^{-3}$ inches to about $6.0\times10^{-3}$ inches. In still another embodiment, the catenary dimples may have a chord depth ranging from about $3.0\times10^{-3}$ inches to about $5.5\times10^{-3}$ inches. In yet another embodiment, the catenary dimples may have a chord depth ranging from about $3.5\times10^{-3}$ inches to about $5.0\times10^{-3}$ inches.

Also in this embodiment, the conical dimples may have saucer ratios (SR) ranging from about 0.05 to about 0.75. For example, the conical dimples have saucer ratios (SR) ranging from about 0.10 to about 0.70. In another embodiment, the conical dimples have saucer ratios (SR) ranging from about 0.15 to about 0.60. In still another embodiment, the conical dimples have saucer ratios (SR) ranging from about 0.20 to about 0.55.

Figure 14B:
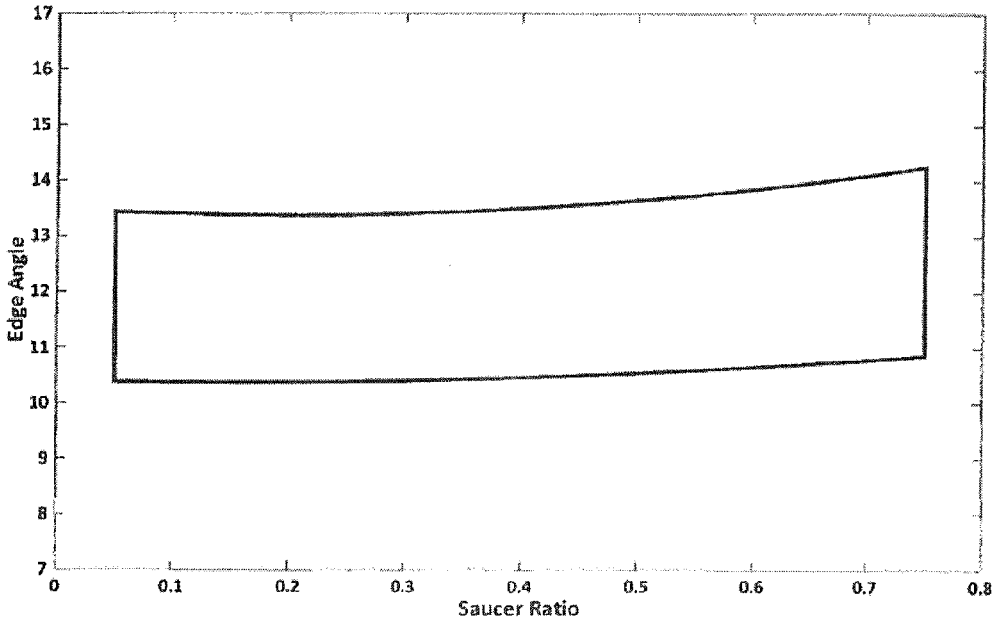
FIG. 14*b* is a graphical representation showing the relationship between edge angles and saucer ratios of conical dimples according to one embodiment of the present invention.

The edge angles (EA) of the conical dimples are related to the above-described saucer ratios (SR) as defined by the ranges shown in FIG. 14B. As shown in FIG. 14B, generally as the saucer ratio (SR) increases, the edge angle (EA) increases as well. For example, as illustrated in FIG. 14B, conical dimples having a saucer ratio of 0.2 have an edge angle ranging from about 10.5 degrees to about 13.5 degrees. In another embodiment, conical dimples having a saucer ratio of 0.4 have an edge angle ranging from about 10.7 degrees to about 13.7 degrees. In still another embodiment, conical dimples having a saucer ratio of 0.75 have an edge angle ranging from about 10.8 degrees to about 14 degrees.

In this aspect, the edge angles of the conical dimples may also be related to the above-described saucer ratios as defined by the following equation:

$$1.33SR^2-0.39SR+10.40 \leq EA \leq 2.85SR^2-1.12SR+13.49 \quad (3)$$

where SR represents the saucer ratio and EA represents the edge angle. Accordingly, the conical dimples in this aspect of the invention may have an edge angle of about 10.4 degrees to about 14.3 degrees. In another embodiment, the conical dimples have an edge angle of about 10.5 degrees to about 14.0 degrees. In still another embodiment, the conical dimples have an edge angle of about 10.8 degrees to about 13.8 degrees. In yet another embodiment, the conical dimples have an edge angle of about 11 degrees to about 13.5 degrees.

In another aspect, when the first hemisphere includes conical dimples and the second hemisphere includes catenary dimples, the corresponding dimples in each pair may have substantially different dimple diameters and the conical dimple in the pair may have a larger diameter than the catenary dimple in the pair. By the term, "substantially different," it is meant a difference in dimple diameter for a given pair of about 0.005 inches to about 0.025 inches. For example, in one embodiment, the difference in dimple diameter for a given pair is about 0.010 inches to about 0.020 inches. In another embodiment, the difference in dimple diameter for a given pair is about 0.014 inches to about 0.018 inches. However, the conical dimple in the pair should maintain a larger dimple diameter than the catenary dimple.

Figure 15A:
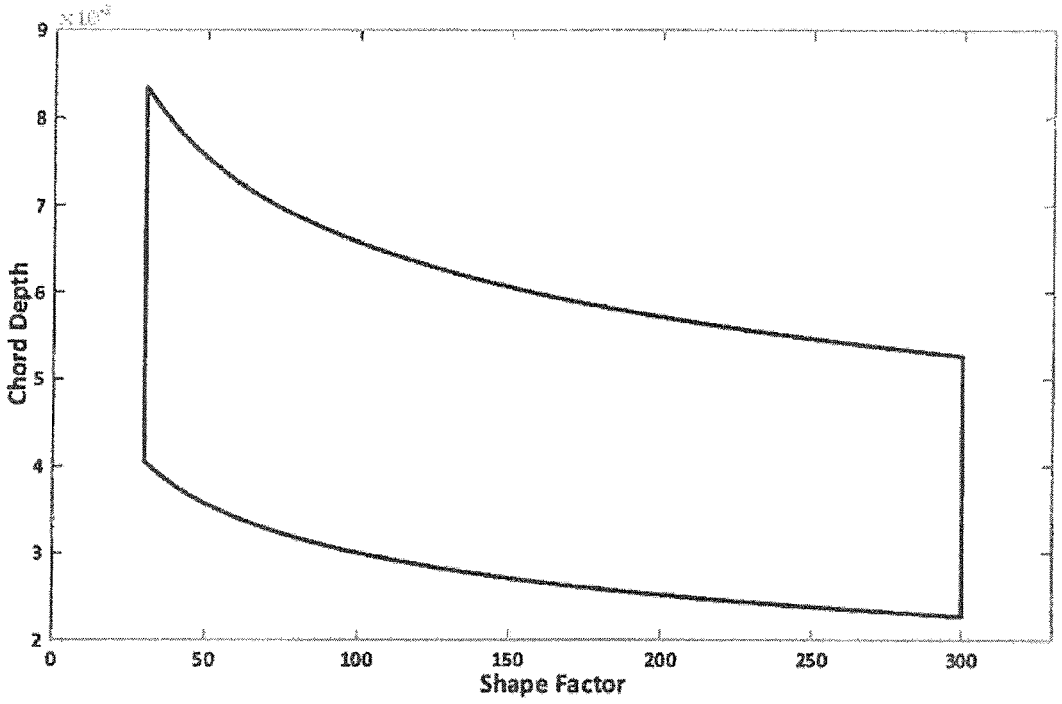
FIG. 15*a* is a graphical representation showing the relationship between chord depths and shape factors of catenary dimples according to another embodiment of the present invention.

In this embodiment, the catenary dimples may have shape factors (sf) as discussed above, for example, between about 30 and about 300. However, the chord depths ($d_c$) of the catenary dimples in this embodiment are related to the shape factors (sf) as defined by the ranges shown in FIG. 15A. As shown in FIG. 15A, generally as the shape factor (sf) increases, the chord depth ($d_c$) decreases. For example, as illustrated in FIG. 15A, catenary dimples having a shape factor of 50 have a chord depth ranging from about $3.8\times10^{-3}$ inches to about $7.8\times10^{-3}$ inches. In another embodiment, catenary dimples having a shape factor of 150 have a chord depth ranging from about $2.8\times10^{-3}$ inches to about $6.2\times10^{-3}$ inches. In still another embodiment, catenary dimples having a shape factor of 300 have a chord depth ranging from about $2.3\times10^{-3}$ inches to about $5.5\times10^{-3}$ inches.

In this aspect, the chord depth of the catenary dimples may also be related to the above-described shape factors as defined by the following equation:

$$\frac{0.0090}{\sqrt[4]{sf}} \leq d_c \leq \frac{0.0165}{\sqrt[5]{sf}} \quad (4)$$

where $d_c$ represents the chord depth and sf represents the shape factor. Accordingly, the catenary dimples may have a chord depth ranging from about $2.3\times10^{-3}$ inches to about $8.4\times10^{-3}$ inches. In another embodiment, the catenary dimples may have a chord depth ranging from about $3.0\times10^{-3}$ inches to about $8.0\times10^{-3}$ inches. In still another embodiment, the catenary dimples may have a chord depth ranging from about $3.5\times10^{-3}$ inches to about $7.5\times10^{-3}$ inches. In yet another embodiment, the catenary dimples may have a chord depth ranging from about $4.0\times10^{-3}$ inches to about $7.0\times10^{-3}$ inches.

Figure 15B:
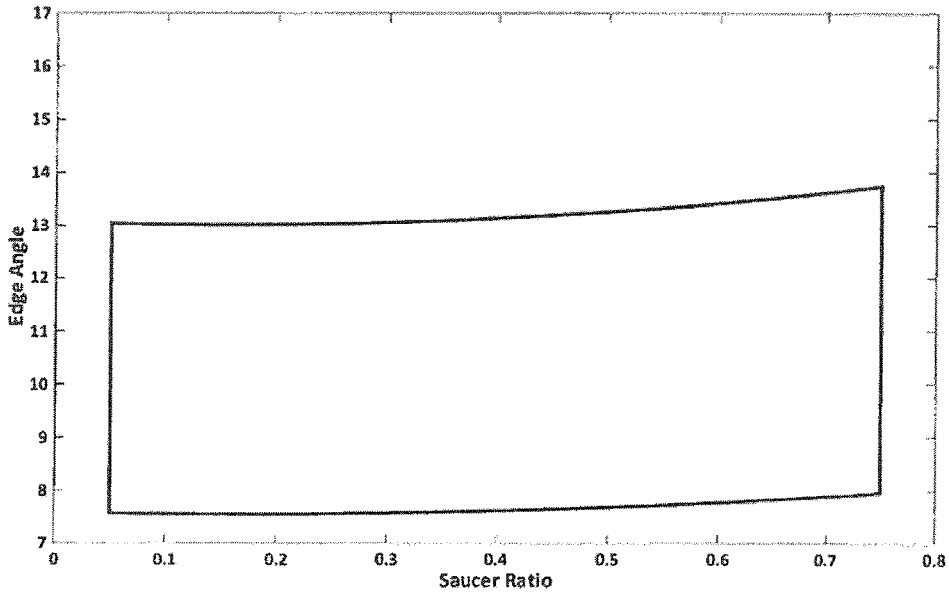
FIG. 15*b* is a graphical representation showing the relationship between edge angles and saucer ratios of conical dimples according to another embodiment of the present invention.

Also in this embodiment, the conical dimples may have saucer ratios (SR) as discussed above, for example, ranging from about 0.05 to about 0.75. However, the edge angles (EA) of the conical dimples in this embodiment are related to the saucer ratios (SR) as defined by the ranges shown in FIG. 15B. As shown in FIG. 15B, as the saucer ratio (SR) increases, the edge angle (EA) slightly increases. For example, as illustrated in FIG. 15B, conical dimples having a saucer ratio of 0.10 have an edge angle ranging from about 7.5 degrees to about 13 degrees. In another embodiment, conical dimples having a saucer ratio of 0.40 have an edge angle ranging from about 7.6 degrees to about 13.1 degrees. In still another embodiment, conical dimples having a saucer ratio of 0.75 have an edge angle ranging from about 7.8 degrees to about 13.8 degrees.

In this aspect, the edge angles of the conical dimples may also be related to the above-described saucer ratios as defined by the following equation:

$$1.18SR^2-0.39SR+7.59 \leq EA \leq 2.08SR^2-0.65SR+13.07 \quad (5)$$

where SR represents the saucer ratio and EA represents the edge angle. Accordingly, the conical dimples in this aspect of the invention may have an edge angle of about 7.6 degrees to about 13.8 degrees. In another embodiment, the conical dimples in this aspect of the invention may have an edge angle of about 8.0 degrees to about 13.0 degrees. In still another embodiment, the conical dimples in this aspect of the invention may have an edge angle of about 8.5 degrees to about 12.5 degrees. In yet another embodiment, the conical dimples in this aspect of the invention may have an edge angle of about 8.8 degrees to about 12.0 degrees.

In still another aspect, when the first hemisphere includes conical dimples and the second hemisphere includes catenary dimples, the corresponding dimples in each pair may have substantially different dimple diameters and the conical dimple in the pair may have a smaller diameter than the catenary dimple in the pair. Indeed, as noted above, the term, "substantially different," means a difference in dimple diameter for a given pair of about 0.005 inches to about 0.025 inches. However, the conical dimple in the pair should maintain a smaller dimple diameter than the catenary dimple.

Figure 16A:
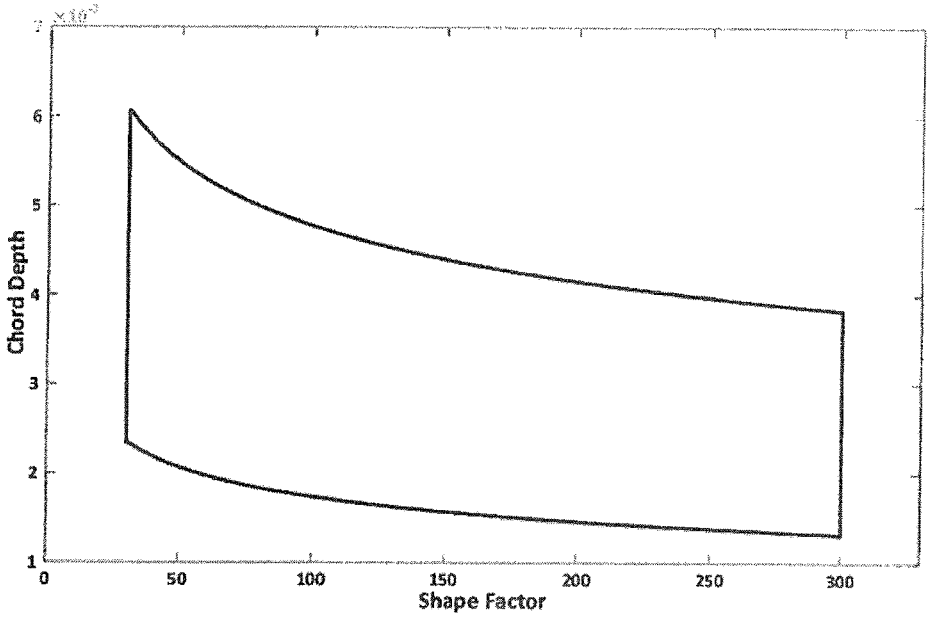
FIG. 16*a* is a graphical representation showing the relationship between chord depths and shape factors of catenary dimples according to still another embodiment of the present invention.

In this embodiment, the catenary dimples may have shape factors (sf) as discussed above, for example, between about 30 and about 300. However, the chord depths ($d_c$) of the catenary dimples in this embodiment are related to the shape factors (sf) as defined by the ranges shown in FIG. 16A. As shown in FIG. 16A, generally as the shape factor (sf) increases, the chord depth ($d_c$) decreases. For instance, as illustrated in FIG. 16A, catenary dimples having a shape factor of 50 have a chord depth ranging from about $2.1\times10^{-3}$ inches to about $5.5\times10^{-3}$ inches. In another embodiment, catenary dimples having a shape factor of 150 have a chord depth ranging from about $1.7\times10^{-3}$ inches to about $4.5\times10^{-3}$ inches. In still another embodiment, catenary dimples having a shape factor of 300 have a chord depth ranging from about $1.4\times10^{-3}$ inches to about $4.0\times10^{-3}$ inches.

In this aspect, the chord depth of the catenary dimples may also be related to the above-described shape factors as defined by the following equation:

$$\frac{0.0055}{\sqrt[4]{sf}} \leq d_c \leq \frac{0.0120}{\sqrt[5]{sf}} \quad (6)$$

where $d_c$ represents the chord depth and sf represents the shape factor. Accordingly, the catenary dimples may have a chord depth ranging from about $2.4\times10^{-3}$ inches to about $6.1\times10^{-3}$ inches. In another embodiment, the catenary dimples may have a chord depth ranging from about $2.8\times10^{-3}$ inches to about $5.5\times10^{-3}$ inches. In still another embodiment, the catenary dimples may have a chord depth ranging from about $3.0\times10^{-3}$ inches to about $5.0\times10^{-3}$ inches. In yet another embodiment, the catenary dimples may have a chord depth ranging from about $3.5\times10^{-3}$ inches to about $4.8\times10^{-3}$ inches.

Figure 16B:
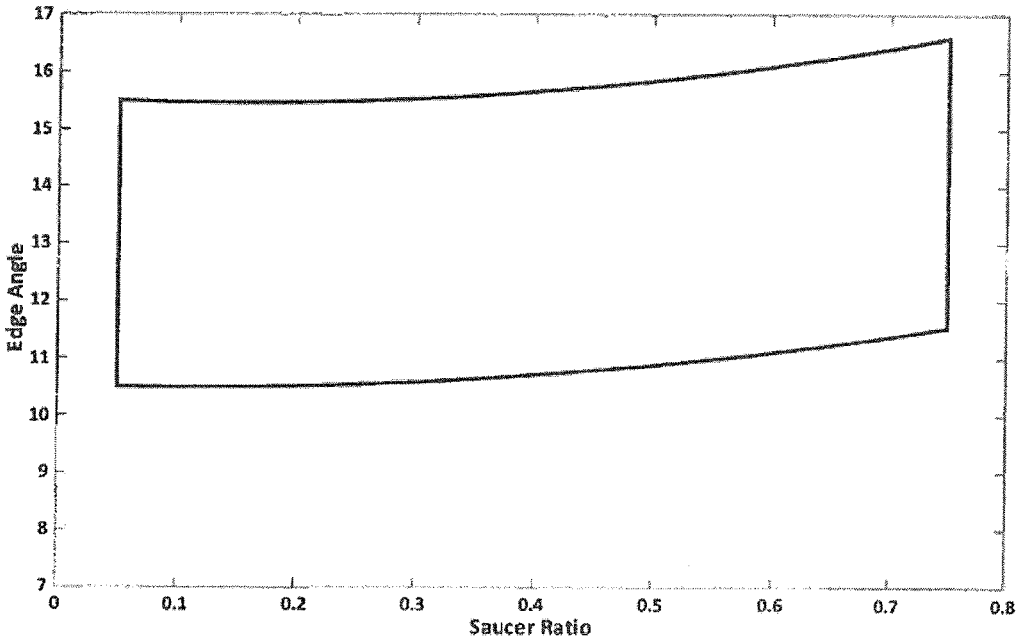
FIG. 16*b* is a graphical representation showing the relationship between edge angles and saucer ratios of conical dimples according to still another embodiment of the present invention.
Figure 17A:
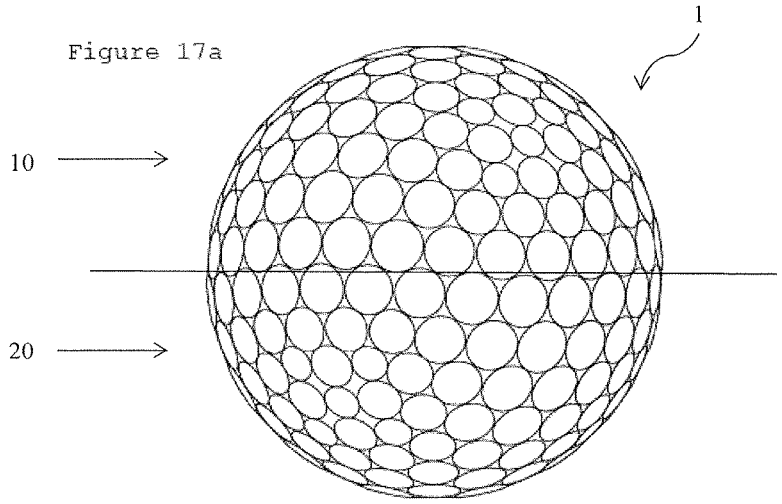
FIG. 17*a* depicts an example of a golf ball having hemispheres with dimples having different geometries based on dimples having like plan shapes with different profiles.
Figure 17B:
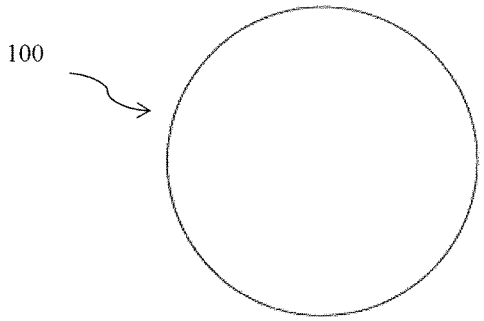
FIG. 17*b* depicts the plan shape of a first dimple in a first hemisphere of the golf ball in FIG. 17*a;*
Figure 17C:
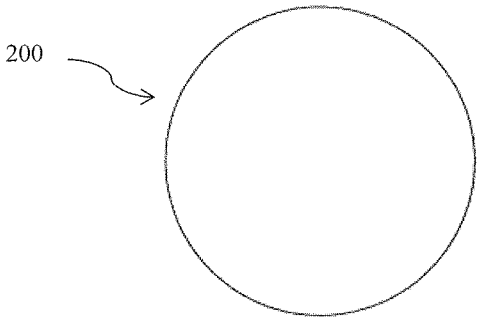
FIG. 17*c* depicts the plan shape of a second dimple in a second hemisphere of the golf ball in FIG. 17*a;*
Figure 17D:
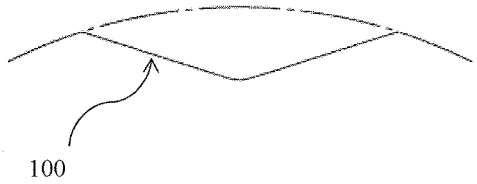
FIG. 17*d* depicts the profile of the first dimple in the first hemisphere of the golf ball in FIG. 17*a;*
Figure 17E:
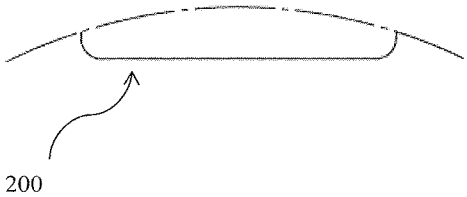
FIG. 17*e* depicts the profile of the second dimple in the second hemisphere of the golf ball in FIG. 17*a;*
Figure 18A:
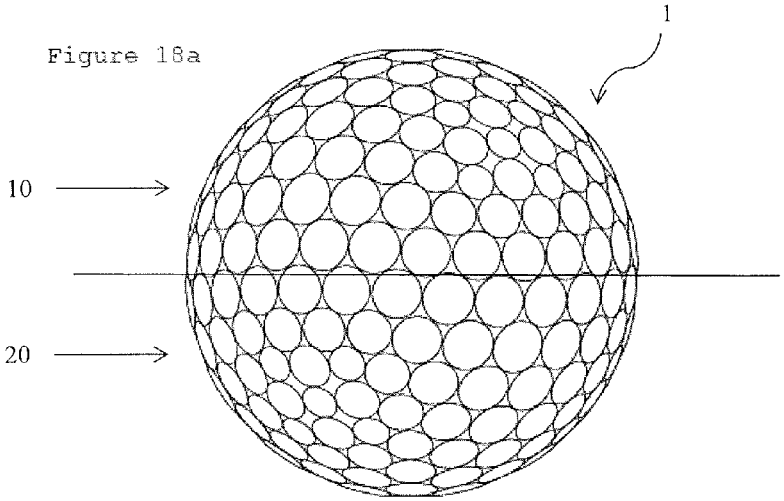
FIG. 18*a* depicts an example of a golf ball having hemispheres with dimples having different geometries based on dimples having like plan shapes with different profiles.
Figure 18B:
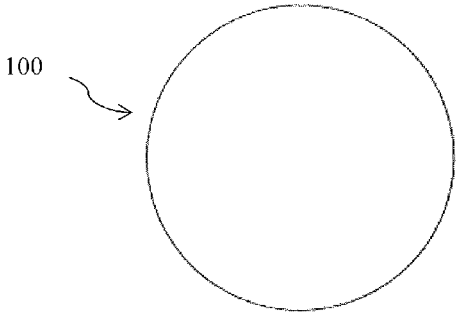
FIG. 18*b* depicts the plan shape of a first dimple in a first hemisphere of the golf ball in FIG. 18*a;*
Figure 18C:
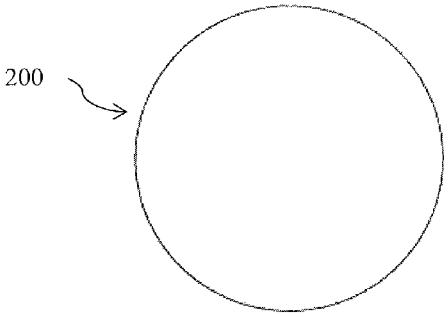
FIG. 18*c* depicts the plan shape of a second dimple in a second hemisphere of the golf ball in FIG. 18*a;*
Figure 18D:
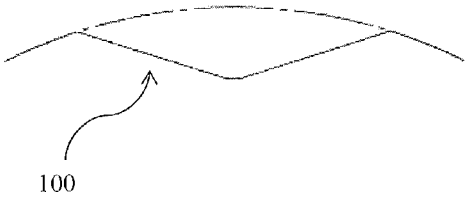
FIG. 18*d* depicts the profile of the first dimple in the first hemisphere of the golf ball in FIG. 18*a*.
Figure 18E:
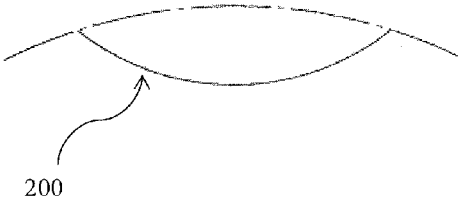
FIG. 18*e* depicts the profile of the second dimple in the second hemisphere of the golf ball in FIG. 18*a*.

Also in this embodiment, the conical dimples may have saucer ratios (SR) as discussed above, for example, ranging from about 0.05 to about 0.75. However, the edge angles (EA) of the conical dimples in this embodiment are related to the saucer ratios (SR) as defined by the ranges shown in FIG. 16B. As shown in FIG. 16B, as the saucer ratio (SR) increases, the edge angle (EA) slightly increases. For example, as illustrated in FIG. 16B, conical dimples having a saucer ratio of 0.05 have an edge angle ranging from about 10.5 degrees to about 15.5 degrees. In another embodiment, conical dimples having a saucer ratio of 0.40 have an edge angle ranging from about 11.2 degrees to about 15.7 degrees. In still another embodiment, conical dimples having a saucer ratio of 0.75 have an edge angle ranging from about 11.6 degrees to about 16.7 degrees.

In this aspect, the edge angles of the conical dimples may also be related to the above-described saucer ratios as defined by the following equation:

$$2.57SR^2-0.56SR+10.52\leq EA\leq 3.22SR^2-0.99SR+15.54 \quad (7)$$

where SR represents the saucer ratio and EA represents the edge angle. Accordingly, the conical dimples in this aspect of the invention may have an edge angle of about 10.5 degrees to about 16.7 degrees. In another embodiment, the conical dimples may have an edge angle of about 11.0 degrees to about 16.0 degrees. In still another embodiment, the conical dimples may have an edge angle of about 12.0 degrees to about 15.0 degrees. In yet another embodiment, the conical dimples may have an edge angle of about 12.5 degrees to about 14.5 degrees.

Spherical Dimple Profile Opposing Conical Dimple Profile

As another example, the present invention contemplates a first hemisphere including dimples having a dimple profile shape defined by a spherical curve and a second, opposing hemisphere including dimples having a conical dimple profile shape.

Figure 13C:
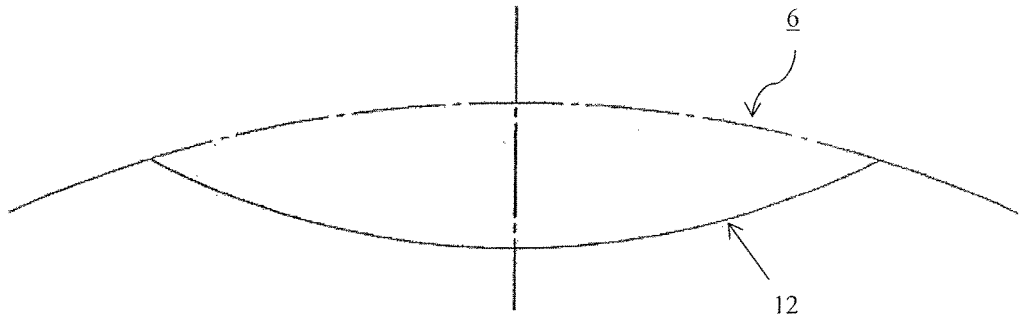

In this embodiment, the first hemisphere may include dimples defined by any spherical curve. FIG. 13C shows a cross-sectional view of a dimple 6 having a spherical profile 12. In this aspect, the present invention contemplates spherical dimple profiles having an edge angle of about 12.0 degrees and 15.5 degrees. In another embodiment, the spherical dimple profiles have an edge angle of about 12.5 degrees to about 15.0 degrees. In still another embodiment, the spherical dimple profiles have an edge angle of about 12.8 degrees to about 14.8 degrees.

The second hemisphere may include dimples having the conical dimple profile shape described above in the preceding section. However, the present invention contemplates dimple diameters for both profiles (i.e., for both the spherical dimples and the conical dimples) of about 0.100 inches to about 0.205 inches. In one embodiment, the dimple diameters are about 0.115 inches to about 0.185 inches. In another embodiment, the dimple diameters are about 0.125 inches to about 0.175 inches. In still another embodiment, the dimple diameters are about 0.130 inches to about 0.155 inches.

In this aspect of the present invention, when the first hemisphere includes spherical dimples and the second hemisphere includes conical dimples, the corresponding dimples in each pair may have substantially equal dimple diameters. By the term, "substantially equal," it is meant a difference in dimple diameter for a given pair of less than about 0.005 inches. For example, in one embodiment, the difference in dimple diameter for a given pair is less than about 0.003 inches. In another embodiment, the difference in dimple diameter for a given pair is less than about 0.0015 inches.

In this embodiment, the conical dimples may have saucer ratios (SR) ranging from about 0.05 to about 0.75. For example, the conical dimples have saucer ratios (SR) ranging from about 0.10 to about 0.70. In another embodiment, the conical dimples have saucer ratios (SR) ranging from about 0.20 to about 0.55. In still another embodiment, the conical dimples have saucer ratios (SR) ranging from about 0.30 to about 0.45.

As discussed above, the edge angles (EA) of the conical dimples are related to the above-described saucer ratios (SR) as defined by the ranges shown in FIG. 14B. FIG. 14B illustrates that over a saucer ratio of about 0.2 to about 0.75, the edge angle may range from about 10.5 degrees to about 14 degrees. Likewise, as noted above, the edge angles of the conical dimples may also be related to the above-described saucer ratios as defined by equation (3) above.

Accordingly, the conical dimples in this aspect of the invention may have an edge angle of about 10.4 degrees to about 14.3 degrees. In another embodiment, the conical dimples have an edge angle of about 10.5 degrees to about 14.0 degrees. In still another embodiment, the conical dimples have an edge angle of about 10.8 degrees to about 13.8 degrees. In yet another embodiment, the conical dimples have an edge angle of about 11 degrees to about 13.5 degrees.

In another aspect, when the first hemisphere includes spherical dimples and the second hemisphere includes conical dimples, the corresponding dimples in each pair may have substantially different dimple diameters and the spherical dimple in the pair may have a larger diameter than the conical dimple in the pair. By the term, "substantially different," it is meant a difference in dimple diameter for a given pair of about 0.005 inches to about 0.025 inches. For example, in one embodiment, the difference in dimple diameter for a given pair is about 0.010 inches to about 0.020 inches. In another embodiment, the difference in dimple diameter for a given pair is about 0.014 inches to about 0.018 inches. However, the spherical dimple in the pair should maintain a larger dimple diameter than the conical dimple.

In this embodiment, the conical dimples may have saucer ratios (SR) as discussed above, for example, ranging from about 0.05 to about 0.75. However, the edge angles (EA) of the conical dimples in this embodiment are related to the saucer ratios (SR) as defined by the ranges shown in FIG. 16B. FIG. 16B illustrates that over a saucer ratio of about 0.05 to about 0.75, the edge angle may range from about 10.5 degrees to about 16.7 degrees. Likewise, as noted above, the edge angles of the conical dimples in this embodiment may also be related to the above-described saucer ratios as defined by equation (7) above.

Accordingly, the conical dimples in this aspect of the invention may have an edge angle of about 10.5 degrees to about 16.7 degrees. In another embodiment, the conical dimples may have an edge angle of about 11.0 degrees to about 16.0 degrees. In still another embodiment, the conical dimples may have an edge angle of about 12.0 degrees to about 15.0 degrees. In yet another embodiment, the conical dimples may have an edge angle of about 12.5 degrees to about 14.5 degrees.

In still another aspect, when the first hemisphere includes spherical dimples and the second hemisphere includes conical dimples, the corresponding dimples in each pair may have substantially different dimple diameters and the spherical dimple in the pair may have a smaller diameter than the conical dimple in the pair. Indeed, as noted above, the term, "substantially different," means a difference in dimple diameter for a given pair of about 0.005 inches to about 0.025 inches. However, the spherical dimple in the pair should maintain a smaller dimple diameter than the conical dimple.

In this embodiment, the conical dimples may have saucer ratios (SR) as discussed above, for example, ranging from about 0.05 to about 0.75. However, the edge angles (EA) of the conical dimples in this embodiment are related to the saucer ratios (SR) as defined by the ranges shown in FIG. 15B. FIG. 15B illustrates that over a saucer ratio of about 0.05 to about 0.75, the edge angle may range from about 7.6 degrees to about 13.8 degrees. Likewise, as noted above, the edge angles of the conical dimples in this embodiment may also be related to the above-described saucer ratios as defined by equation (5) above.

Accordingly, the conical dimples in this aspect of the invention may have an edge angle of about 7.6 degrees to about 13.8 degrees. In another embodiment, the conical dimples in this aspect of the invention may have an edge angle of about 8.0 degrees to about 13.0 degrees. In still another embodiment, the conical dimples in this aspect of the invention may have an edge angle of about 8.5 degrees to about 12.5 degrees. In yet another embodiment, the conical dimples in this aspect of the invention may have an edge angle of about 8.8 degrees to about 12.0 degrees.

Spherical Dimple Profile Opposing Catenary Dimple Profile

In still another example, the present invention contemplates a first hemisphere including dimples having a dimple profile shape defined by a spherical curve and a second, opposing hemisphere including dimples having a dimple profile shape defined by a catenary curve.

In this embodiment, the first and second hemisphere may include the spherical dimple profile and the catenary dimple profile described above in the preceding sections. However, the present invention contemplates dimple diameters for both profiles (i.e., for both the spherical dimples and the catenary dimples) of about 0.100 inches to about 0.205 inches. In one embodiment, the dimple diameters are about 0.115 inches to about 0.185 inches. In another embodiment, the dimple diameters are about 0.125 inches to about 0.175 inches. In still another embodiment, the dimple diameters are about 0.130 inches to about 0.155 inches.

In this aspect of the present invention, when the first hemisphere includes spherical dimples and the second hemisphere includes catenary dimples, the corresponding dimples in each pair may have substantially equal dimple diameters. By the term, "substantially equal," it is meant a difference in dimple diameter for a given pair of less than about 0.005 inches. For example, in one embodiment, the difference in dimple diameter for a given pair is less than about 0.003 inches. In another embodiment, the difference in dimple diameter for a given pair is less than about 0.0015 inches.

In this embodiment, the catenary dimples may have shape factors (sf) between about 30 and about 300. In another embodiment, the catenary dimples have shape factors (sf) between about 50 and about 250. In still another embodiment, the catenary dimples have shape factors (sf) between about 75 and about 225. In yet another embodiment, the catenary dimples have shape factors (sf) between about 100 and 200.

As discussed above, the chord depths ($d_c$) of the catenary dimples are related to the above-described shape factors (sf) as defined by the ranges shown in FIG. 14A. FIG. 14A illustrates that over a shape factor range of about 50 to about 250, catenary dimples have a chord depth ranging from about $3.8\times10^{-3}$ inches to about $6.3\times10^{-3}$ inches. Likewise, as noted above, the chord depth of the catenary dimples may also be related to the above-described shape factors as defined by equation (2) above.

Accordingly, the catenary dimples in this aspect may have a chord depth ranging from about $2.0\times10^{-3}$ inches to about $6.5\times10^{-3}$ inches. In another embodiment, the catenary dimples may have a chord depth ranging from about $2.510^{-3}$ inches to about $6.0\times10^{-3}$ inches. In still another embodiment, the catenary dimples may have a chord depth ranging from about $3.0\times10^{-3}$ inches to about $5.5\times10^{-3}$ inches. In yet another embodiment, the catenary dimples may have a chord depth ranging from about $3.5\times10^{-3}$ inches to about $5.0\times10^{-3}$ inches.

In another aspect, when the first hemisphere includes spherical dimples and the second hemisphere includes catenary dimples, the corresponding dimples in each pair may have substantially different dimple diameters and the spherical dimple in the pair may have a larger diameter than the catenary dimple in the pair. By the term, "substantially different," it is meant a difference in dimple diameter for a given pair of about 0.005 inches to about 0.025 inches. For example, in one embodiment, the difference in dimple diameter for a given pair is about 0.010 inches to about 0.020 inches. In another embodiment, the difference in dimple diameter for a given pair is about 0.014 inches to about 0.018 inches. However, the spherical dimple in the pair should maintain a larger dimple diameter than the catenary dimple.

In this embodiment, the catenary dimples may have shape factors (sf) as discussed above, for example, between about 30 and about 300. However, the chord depths ($d_c$) of the catenary dimples in this embodiment are related to the shape factors (sf) as defined by the ranges shown in FIG. 15A. FIG. 15A illustrates that over a shape factor range of about 50 to about 300, catenary dimples have a chord depth ranging from about $3.8\times10^{-3}$ inches to about $7.8\times10^{-3}$ inches. Likewise, as noted above, the chord depth of the catenary dimples may also be related to the above-described shape factors as defined by equation (4) above.

Accordingly, the catenary dimples in this aspect may have a chord depth ranging from about $2.3\times10^{-3}$ inches to about $8.4\times10^{-3}$ inches. In another embodiment, the catenary dimples may have a chord depth ranging from about $3.0\times10^{-3}$ inches to about $8.0\times10^{-3}$ inches. In still another embodiment, the catenary dimples may have a chord depth ranging from about $3.5\times10^{-3}$ inches to about $7.5\times10^{-3}$ inches. In yet another embodiment, the catenary dimples may have a chord depth ranging from about $4.0\times10^{-3}$ inches to about $7.0\times10^{-3}$ inches.

In still another aspect, when the first hemisphere includes spherical dimples and the second hemisphere includes catenary dimples, the corresponding dimples in each pair may have substantially different dimple diameters and the spherical dimple in the pair may have a smaller diameter than the catenary dimple in the pair. Indeed, as noted above, the term, "substantially different," means a difference in dimple diameter for a given pair of about 0.005 inches to about 0.025 inches. However, the spherical dimple in the pair should maintain a smaller dimple diameter than the catenary dimple.

In this embodiment, the catenary dimples may have shape factors (sf) as discussed above, for example, between about 30 and about 300. However, the chord depths ($d_c$) of the catenary dimples in this embodiment are related to the shape factors (sf) as defined by the ranges shown in FIG. 16A. FIG. 16A illustrates that over a shape factor range of about 50 to about 300, catenary dimples have a chord depth ranging from about $2.1\times10^{-3}$ inches to about $5.5\times10^{-3}$ inches. Likewise, as noted above, the chord depth of the catenary dimples may also be related to the above-described shape factors as defined by equation (6) above.

Accordingly, the catenary dimples in this aspect may have a chord depth ranging from about $2.4\times10^{-3}$ inches to about $6.1\times10^{-3}$ inches. In another embodiment, the catenary dimples may have a chord depth ranging from about $2.8\times10^{-3}$ inches to about $5.5\times10^{-3}$ inches. In still another embodiment, the catenary dimples may have a chord depth ranging from about $3.0\times10^{-3}$ inches to about $5.0\times10^{-3}$ inches. In yet another embodiment, the catenary dimples may have a chord depth ranging from about $3.5\times10^{-3}$ inches to about $4.8\times10^{-3}$ inches.

In one embodiment, at least about 25 percent of the corresponding dimples in the opposing hemispheres have different profile shapes and different plan shapes. In another embodiment, at least about 50 percent of the corresponding dimples in the opposing hemispheres have different profile shapes and different plan shapes. In yet another embodiment, at least about 75 percent of the corresponding dimples in the opposing hemispheres have different profile shapes and different plan shapes. In still another embodiment, all of the corresponding dimples in the opposing hemispheres have different profile shapes and different plan shapes.

Volumetric Equivalence

As discussed above, even though the dimple geometries on opposing hemispheres differ in that dimples in at least one pair of corresponding dimples have different plan shapes, profile shapes, or a combination thereof, the hemispheres have the same dimple arrangement. Similarly, even though the dimple geometries in the opposing hemispheres differ, an appropriate degree of volumetric equivalence is maintained between the two hemispheres. In this aspect of the invention, the dimples in one hemisphere have dimple volumes similar to the dimple volumes of the dimples in the other hemisphere.

Figure 7:
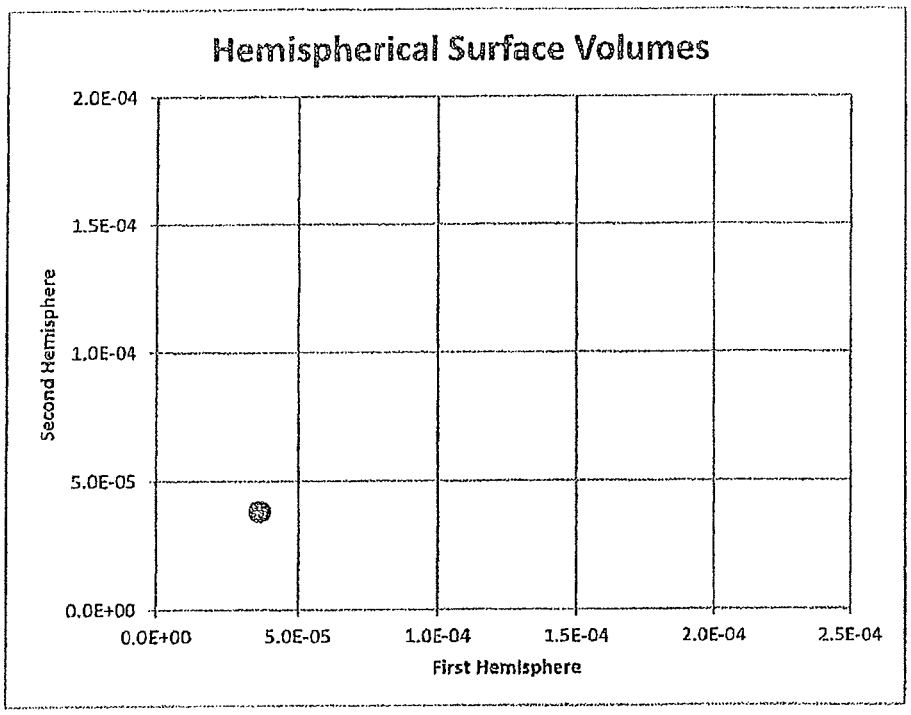
FIG. 7 depicts a volumetric plotting based on the surface volumes of the two corresponding dimples in FIG. 1.
Figure 8:
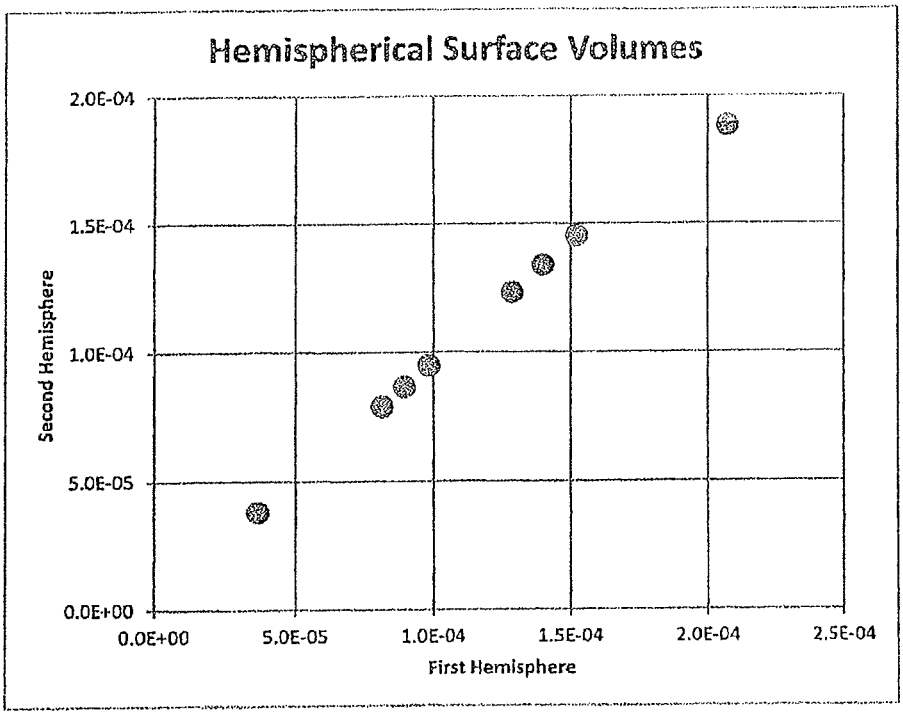
FIG. 8 depicts a volumetric plotting and linear regression analysis based on the surface volumes of a plurality of corresponding dimples from the golf ball in FIG. 1.
Figure 9A:
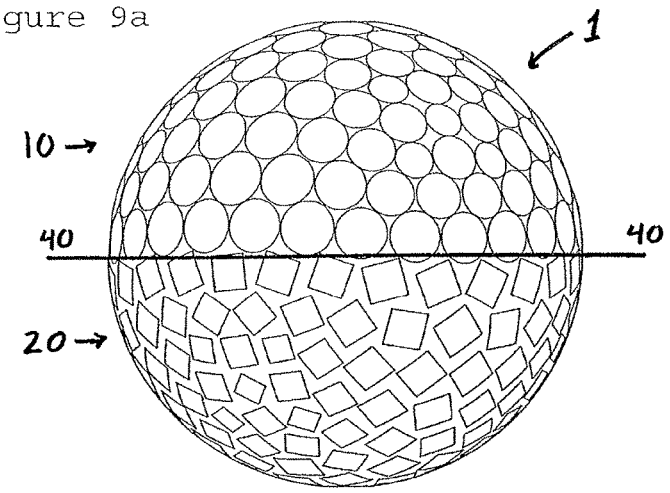
FIG. 9*a* depicts an example of a golf ball having hemispheres with dimples having different geometries based on dimples having different plan shapes with like profiles.
Figure 9B:
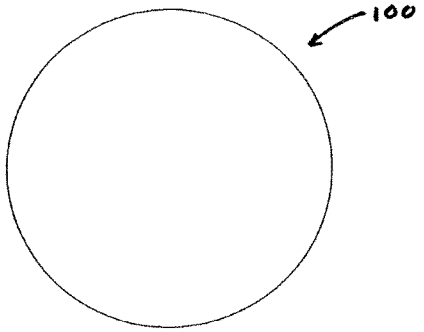
FIG. 9*b* depicts the plan shape of a first dimple in a first hemisphere of the golf ball in FIG. 9*a;*
Figure 9C:
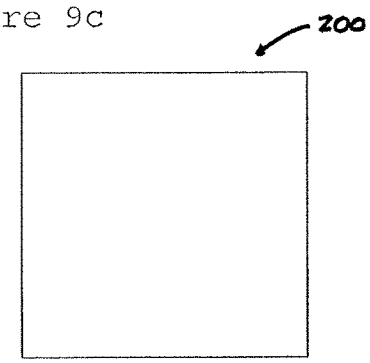
FIG. 9*c* depicts the plan shape of a second dimple in a second hemisphere of the golf ball in FIG. 9*a;*
Figure 9D:
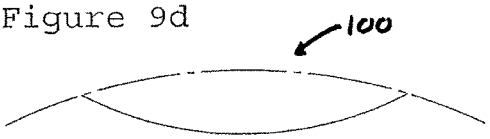
FIG. 9*d* depicts the profile of the first dimple in the first hemisphere of the golf ball in FIG. 9*a;*
Figure 9E:
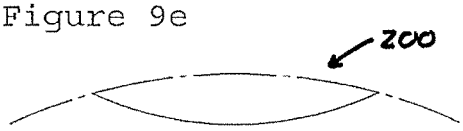
FIG. 9*e* depicts the profile of the second dimple in the second hemisphere of the golf ball in FIG. 9*a;*
Figure 10A:
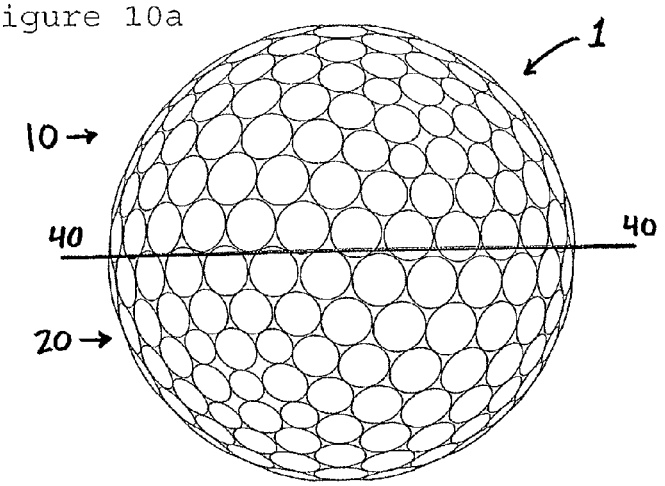
FIG. 10*a* depicts an example of a golf ball having hemispheres with dimples having different geometries based on dimples having like plan shapes with different profiles.
Figure 10B:
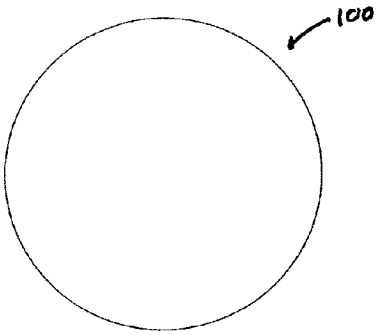
FIG. 10*b* depicts the plan shape of a first dimple in a first hemisphere of the golf ball in FIG. 10*a;*
Figure 10C:
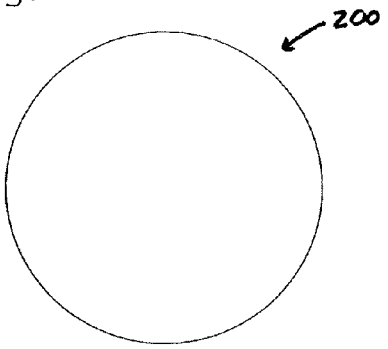
FIG. 10*c* depicts the plan shape of a second dimple in a second hemisphere of the golf ball in FIG. 10*a;*
Figure 10D:
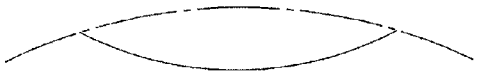
FIG. 10*d* depicts the profile of the first dimple in the first hemisphere of the golf ball in FIG. 10*a;*
Figure 10E:
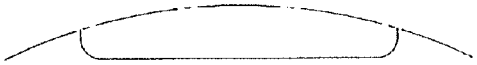
FIG. 10*e* depicts the profile of the second dimple in the second hemisphere of the golf ball in FIG. 10*a;*
Figure 11A:
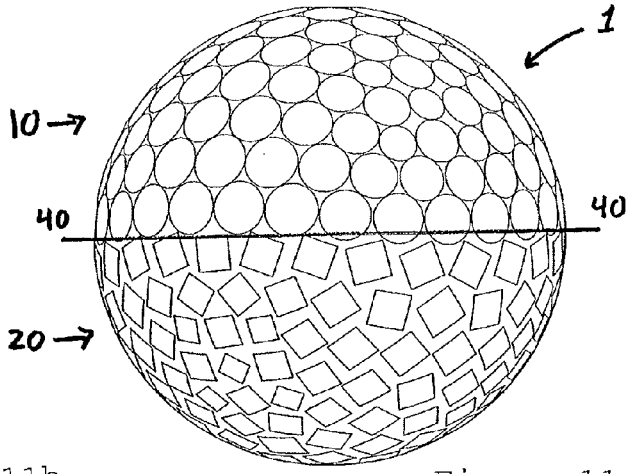
FIG. 11*a* depicts an example of a golf ball having hemispheres with dimples having different geometries based on dimples having different plan shapes and different profiles.
Figure 11B:
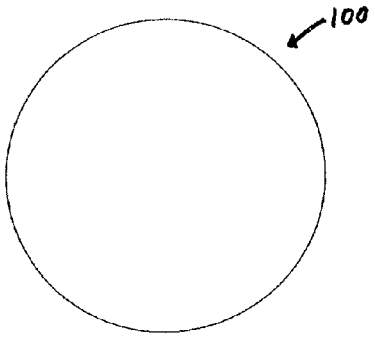
FIG. 11*b* depicts the plan shape of a first dimple in a first hemisphere of the golf ball in FIG. 11*a;*
Figure 11C:
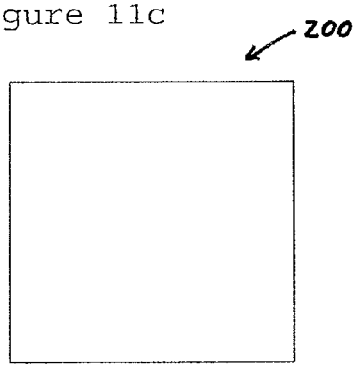
FIG. 11*c* depicts the plan shape of a second dimple in a second hemisphere of the golf ball in FIG. 11*a;*
Figure 11D:
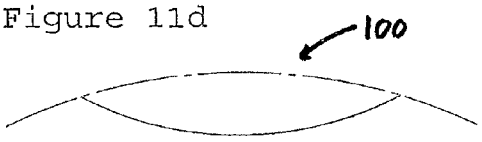
FIG. 11*d* depicts the profile of the first dimple in the first hemisphere of the golf ball in FIG. 11*a;*
Figure 11E:
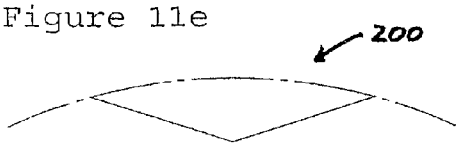
FIG. 11*e* depicts the profile of the second dimple in the second hemisphere of the golf ball in FIG. 11*a;*
Figure 12A:
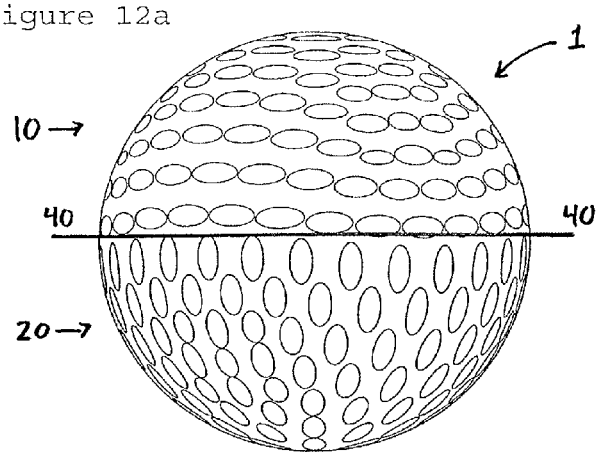
FIG. 12*a* depicts an example of a golf ball having hemispheres with dimples having different geometries based on dimples having like plan shapes and like profiles, with different plan shape orientations.
Figure 12B:
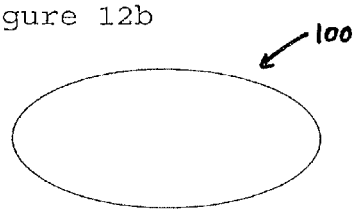
FIG. 12*b* depicts the plan shape of a first dimple in a first hemisphere of the golf ball in FIG. 12*a;*
Figure 12C:
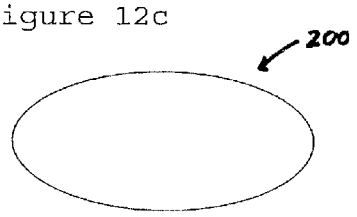
FIG. 12*c* depicts the plan shape of a second dimple in a second hemisphere of the golf ball in FIG. 12*a;*
Figure 12D:
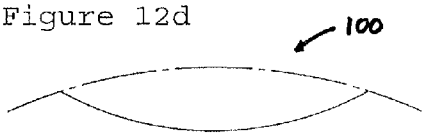
FIG. 12*d* depicts the profile of the first dimple in the first hemisphere of the golf ball in FIG. 12*a;*
Figure 12E:
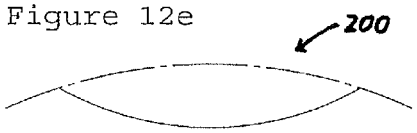
FIG. 12*e* depicts the profile of the second dimple in the second hemisphere of the golf ball in FIG. 12*a;*

Volumetric equivalence of two hemispheres of a golf ball may be assessed via a regression analysis of dimple surface volumes. This may be done by calculating the surface volumes of the two dimples in a pair of corresponding dimples 100/200, and plotting the calculated surface volumes of the two dimples against one another. An example of a surface volume plotting is shown in FIG. 7, where a first axis (e.g., the horizontal axis) represents the surface volume of the dimple 100 in the first hemisphere 10 and a second axis (e.g., the vertical axis) represents the surface volume of the dimple 200 in the second hemisphere 20. This calculation and plotting of surface volumes is repeated for each pair of corresponding dimples 100/200 sampled, such that there is obtained a multi-point plot with a plotted point for all pairs of corresponding dimples sampled. An example of a simplified multi-point plot is shown in FIG. 8. In one embodiment, at least 25 percent of the corresponding dimples are included in the multi-point plot. In another embodiment, at least 50 percent of the corresponding dimples are included in the multi-point plot. In yet another embodiment, at least 75 percent of the corresponding dimples are included in the multi-point plot. In still another embodiment, all of the corresponding dimples on the ball are included in the multi-point plot.

After the surface volumes for all pairs of corresponding dimples 100/200 have been calculated and plotted, linear regression analysis is performed on the data to yield coefficients in the form $y=\alpha+\beta x$. It should be understood by one of ordinary skill in the art the linear function y uses least squares regression to determine the slope $\beta$ and the y-intercept $\alpha$, where x represents the surface volume from the dimple on the first hemisphere and y represents the surface volume of the dimple on the second hemisphere. Two hemispheres are considered to have volumetric equivalence when two conditions are met. First, the coefficient $\beta$ must be about one—which is to say that the coefficient $\beta$ must be within a range from about 0.90 to about 1.10; preferably from about 0.95 to about 1.05. Second, a coefficient of determination $R^2$ must be about one—which is to say that the coefficient of determination $R^2$ must be greater than about 0.90; preferably greater than about 0.95. In order to satisfy the requirement of volumetric equivalence both of these conditions must be met.

Thus, a suitable dimple pattern has a coefficient $\beta$ that ranges from about 0.90 to about 1.10 and a coefficient of determination $R^2$ greater than about 0.90.

Dimple Dimensions

The dimples on golf balls according to the present invention may comprise any width, depth, and edge angle; and the dimple patterns may comprise multitudes of dimples having different widths, depths, and edge angles. In one embodiment, the surface volume of dimples in a golf ball according to the present invention is within a range of about 0.000001 $in^3$ to about 0.0005 $in^3$. In one embodiment, the surface volume is about 0.00003 $in^3$ to about 0.0005 $in^3$. In another embodiment, the surface volume is about 0.00003 $in^3$ to about 0.00035 $in^3$.

Golf Ball Construction

Dimple patterns according to the present invention may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers.

Different materials may be used in the construction of golf balls according to the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

EXAMPLES

The following non-limiting examples demonstrate dimple patterns that may be made in accordance with the present invention. The examples are merely illustrative of the preferred embodiments of the present invention, and are not to be construed as limiting the invention, the scope of which is defined by the appended claims. In fact, it will be appreciated by those skilled in the art that golf balls according to the present invention may take on a number of permutations, provided volumetric equivalence between the two hemispheres is achieved. Again, volumetric equivalence between two hemispheres may be achieved by adapting the surface volumes of the dimples in the two separate hemispheres to yield substantially identical hemispherical volumes, in accord with the discussion above.

Golf Ball with Dimple Patterns Having Differing Plan Shapes

FIGS. 9*a*-9*e* present one example of a golf ball 1 according to the present invention wherein dimples 100 in a first hemisphere 10 differ from dimples 200 in a second hemisphere 20 based, at least, on a difference in plan shapes. As shown in FIGS. 9*a*-9*e*, the difference in plan shapes may be one wherein the plan shapes of the dimples 100 in the first-hemisphere 10 are of a shape (e.g., circular, square, triangle, rectangle, oval, or any other geometric or non-geometric shape) that is different from the shape of the plan shapes of the dimples 200 in the second-hemisphere 20. In a variation of this example, the plan shapes of the first-hemisphere dimples may be of a shape (e.g., circular, square, triangle, rectangle, oval, or any other geometric or non-geometric shape) that is the same as the shape of the plan shapes of the second-hemisphere dimples; though the two plan shapes may be of different sizes (e.g., both dimple plan shapes may have a circular plan shape, though one circular plan shape may have a smaller diameter than the other) or of different orientations (such as the example illustrated in FIGS. 12*a*-12*e*).

Golf Ball with Dimple Patterns Having Differing Profiles

FIGS. 10*a*-10*e* present one example of a golf ball 1 according to the present invention wherein dimples 100 in a first hemisphere 10 differ from dimples 200 in a second hemisphere 20 based, at least, on a difference in profile. For example, as shown in FIGS. 10*a*-10*e*, the first and second hemisphere dimples 100/200 may both have circular plan shapes, though the first hemisphere dimples 100 may have arcuate profiles while the second hemisphere dimples 200 have substantially planar profiles. In a variation of this example, the difference in profile may be one wherein the profile of the first-hemisphere dimples correspond to a curve and the profile of the second-hemisphere dimples correspond to a truncated cone.

FIGS. 17*a*-17*e* present another example of a golf ball 1 according to the present invention where dimples 100 in a first hemisphere 10 differ from dimples 200 in a second hemisphere 20 based, at least, on a difference in profile. For example, as shown in FIGS. 17*a*-17*e*, the first and second hemisphere dimples 100/200 may both have circular plan shapes, though the first hemisphere dimples 100 may have conical profiles while the second hemisphere dimples 200 have profiles defined by a catenary curve.

FIGS. 18*a*-18*e* present yet another example of a golf ball 1 according to the present invention where dimples 100 in a first hemisphere 10 differ from dimples 200 in a second hemisphere 20 based, at least, on a difference in profile. For example, as shown in FIGS. 18*a*-18*e*, the first and second hemisphere dimples 100/200 may both have circular plan shapes, though the first hemisphere dimples 100 may have conical profiles while the second hemisphere dimples 200 have spherical profiles.

Golf Ball with Dimple Patterns Having Differing Plan and Profile Shapes

FIGS. 11*a*-11*e* presents one example of a golf ball 1 according to the present invention wherein dimples 100 in a first hemisphere 10 differ from dimples 200 in a second hemisphere 20 based, both, on a difference in plan shapes (e.g., circular versus square) and a difference in profiles (e.g., arcuate versus conical).

Although the present invention is described with reference to particular embodiments, it will be understood to those skilled in the art that the foregoing disclosure addresses exemplary embodiments only; that the scope of the invention is not limited to the disclosed embodiments; and that the scope of the invention may encompass additional embodiments embracing various changes and modifications relative to the examples disclosed herein without departing from the scope of the invention as defined in the appended claims and equivalents thereto.

Though the foregoing disclosure describes the invention relative to examples of golf balls having two different hemispheres with dimple patterns having different dimples, those skilled in the art will appreciate the invention may also be practiced with golf balls that are divided into another number of different regions (e.g., patterns based on tetrahedrons, octahedrons, cuboctahedrons, icosahedrons, icosadodecahedrons, and dipyramids).

To the extent necessary to understand or complete the disclosure of the present invention, all publications, patents, and patent applications mentioned herein are expressly incorporated by reference herein to the same extent as though each were individually so incorporated. No license, express or implied, is granted to any patent incorporated herein. Ranges expressed in the disclosure include the endpoints of each range, all values in between the endpoints, and all intermediate ranges subsumed by the endpoints.

The present invention is not limited to the exemplary embodiments illustrated herein, but is instead characterized by the appended claims.

What is claimed is:

1. A golf ball comprising:

a first hemisphere comprising a first plurality of dimples; and a second hemisphere comprising a second plurality of dimples, wherein each dimple in the first plurality of dimples has a corresponding dimple in the second plurality of dimples, wherein a dimple in the first hemisphere comprises a first profile shape and a corresponding dimple in the second hemisphere comprises a second profile shape, wherein the first profile shape is different from the second profile shape and the first and second profile shapes are selected from spherical or catenary, wherein the spherical profile shape has an edge angle of about 12.0 degrees to about 15.5 degrees, and the catenary profile shape has a shape factor of about 30 to about 300 and a chord depth of about $2.0\times10^{-3}$ inches to about $6.5\times10^{-3}$ inches, and wherein the dimple in the first hemisphere and the corresponding dimple in the second hemisphere have substantially identical surface volumes.

2. The golf ball of claim 1, wherein the first profile shape is spherical and the second profile shape is catenary.

3. The golf ball of claim 1, wherein the first profile shape is catenary and the second profile shape is spherical.

4. A golf ball, comprising:

a first hemisphere comprising a plurality of dimples; and a second hemisphere comprising a plurality of dimples, wherein a first dimple in the first hemisphere comprises a first plan shape, a first profile shape, and a first geometric center, the first geometric center being located at a position defined by a first polar angle $\theta_N$ measured from a pole of the first hemisphere;

a second dimple in the second hemisphere comprises a second plan shape, a second profile shape, and a second geometric center, the second geometric center being located at a position defined by a second polar angle $\theta_S$ measured from a pole of the second hemisphere;

the first polar angle $\theta_N$ differs from the second polar angle $\theta_S$ by no more than 3°;

the first profile shape is different from the second profile shape and the first and second profile shapes are selected from spherical or conical;

the spherical profile shape has an edge angle of about 12.0 degrees to about 15.5 degrees, and the conical profile shape has a saucer ratio of bout 0.05 to about 0.75 and an edge angle of about 10.4 degrees to about 14.3 degrees;

the first dimple and the second dimple have substantially equal dimple diameters; and the first dimple and the second dimple have substantially identical surface volumes.

5. The golf ball of claim 4, wherein the geometric center of the first dimple is separated from the geometric center of the second dimple by an offset angle $\gamma$.

6. The golf ball of claim 4, wherein the first profile shape is spherical and the second profile shape is conical.

7. The golf ball of claim 4, wherein the first and second dimples have a dimple diameter ranging from about 0.100 inches to about 0.205 inches.

8. A golf ball, comprising:

a first hemisphere comprising a plurality of dimples; and a second hemisphere comprising a plurality of dimples, wherein a first dimple in the first hemisphere comprises a first plan shape, a first profile shape, and a first geometric center, the first geometric center being located at a position defined by a first polar angle $\theta_N$ measured from a pole of the first hemisphere;

a second dimple in the second hemisphere comprises a second plan shape, a second profile shape, and a second geometric center, the second geometric center being located at a position defined by a second polar angle $\theta_S$ measured from a pole of the second hemisphere;

the first polar angle $\theta_N$ differs from the second polar angle $\theta_S$ by no more than 3°;

the first profile shape is conical and the second profile shape is catenary;

the conical profile shape has a saucer ratio of about 0.05 to about 0.75 and an edge angle of about 7.6 degrees to about 13.8 degrees, and the catenary profile shape has a shape factor of about 30 to about 300 and a chord depth of about $2.3\times10^{-3}$ inches to about $8.4\times10^{-3}$ inches;

the first dimple and the second dimple have substantially different dimple diameters and the first dimple has a larger dimple diameter than the second dimple; and the first dimple and the second dimple have substantially identical surface volumes.

9. The golf ball of claim 8, wherein the first and second dimples have a dimple diameter ranging from about 0.100 inches to about 0.205 inches.

10. The golf ball of claim 1, wherein the dimple in the first hemisphere and the corresponding dimple in the second hemisphere have substantially equal dimple diameters.

11. The golf ball of claim 1, wherein the catenary profile shape has a shape factor of about 50 to about 250 and a chord depth of about $3.8\times10^{3}$ inches to about $6.3\times10^{-3}$ inches.

12. The golf ball of claim 4, wherein the first profile shape is conical and the second profile shape is spherical.

13. The golf ball of claim 8, wherein the difference in dimple diameter between the first dimple and the second dimple is about 0.005 inches to about 0.025 inches.

14. The golf ball of claim 8, wherein the difference in dimple diameter between the first dimple and the second dimple is about 0.010 inches to about 0.020 inches.

* * * * *